US010105574B2

(12) United States Patent
Rider et al.

(10) Patent No.: US 10,105,574 B2
(45) Date of Patent: Oct. 23, 2018

(54) TECHNOLOGIES FOR MANAGING USER-SPECIFIC WORKOUTS

(71) Applicant: Intel Corporation, Santa Clara, CA (US)

(72) Inventors: Tomer Rider, Naahryia (IL); Igor Tatourian, Fountain Hills, AZ (US); Shahar Taite, Kfar Saba (IL)

(73) Assignee: Intel Corporation, Santa Clara, CA (US)

( * ) Notice: Subject to any disclaimer, the term of this patent is extended or adjusted under 35 U.S.C. 154(b) by 93 days.

(21) Appl. No.: 14/976,531

(22) Filed: Dec. 21, 2015

(65) Prior Publication Data

US 2017/0173394 A1 Jun. 22, 2017

(51) Int. Cl.

| | |
|---|---|
| ***A63B 24/00*** | (2006.01) |
| *A63B 22/02* | (2006.01) |
| *A63B 21/072* | (2006.01) |
| *A63B 22/00* | (2006.01) |
| *A63B 22/06* | (2006.01) |

(52) U.S. Cl.

CPC ..... *A63B 24/0075* (2013.01); *A63B 24/0087* (2013.01); *A63B 21/072* (2013.01); *A63B 22/0076* (2013.01); *A63B 22/02* (2013.01); *A63B 22/0664* (2013.01); *A63B 2024/0093* (2013.01); *A63B 2220/12* (2013.01); *A63B 2220/13* (2013.01); *A63B 2220/40* (2013.01); *A63B 2220/803* (2013.01); *A63B 2220/807* (2013.01); *A63B 2220/808* (2013.01); *A63B 2225/50* (2013.01); *A63B 2230/06* (2013.01); *A63B 2230/10* (2013.01); *A63B 2230/50* (2013.01)

(58) Field of Classification Search

CPC . A63B 24/00; A63B 24/0062; A63B 24/0087; A63B 24/0075; A63B 2024/0093; A63B 2230/50; A63B 2230/10; A63B 2230/06; A63B 2220/12; A63B 2220/13; A63B 2220/40; A63B 2220/803; A63B 2220/807; A63B 2220/808; A63B 22/0076; A63B 22/0064; A63B 22/02; A63B 2225/50

See application file for complete search history.

(56) References Cited

U.S. PATENT DOCUMENTS

| | | | | |
|---|---|---|---|---|
| 7,601,097 | B2 * | 10/2009 | Miyamaru | A63B 22/0605 434/61 |
| 7,628,737 | B2 * | 12/2009 | Kowallis | A63B 21/00072 482/1 |
| 7,789,816 | B2 * | 9/2010 | Krietzman | A63B 21/0051 482/139 |
| 8,219,263 | B2 * | 7/2012 | Takeda | B62J 99/00 455/456.1 |

(Continued)

*Primary Examiner* — Glenn Richman
(74) *Attorney, Agent, or Firm* — Barnes & Thornburg LLP

(57) ABSTRACT

Technologies for generating user-specific workout plans and tracking a user's progress are disclosed. The user-specific workout plan may be based on a user's goal and the particular workout facility to be used by the user. During performance of the user-specific workout by the user, the user is provided with workout data regarding the user's performance. Such workout data may be based on sensor data generated by sensors of the exercise machine used by the user and/or other sensors carried or worn by the user.

24 Claims, 9 Drawing Sheets

(56) References Cited

U.S. PATENT DOCUMENTS

| | | | | |
|---|---|---|---|---|
| 8,221,295 | B2 * | 7/2012 | Wilkins | A63B 5/00 482/130 |
| 8,337,365 | B2 * | 12/2012 | Kim | A63B 21/065 482/8 |
| 8,409,057 | B2 * | 4/2013 | Martens | A63B 22/00 482/1 |
| 8,574,131 | B2 * | 11/2013 | Daly | A63B 22/0235 482/51 |
| 8,956,290 | B2 * | 2/2015 | Gilley | G06Q 10/06 600/301 |

* cited by examiner

TECHNOLOGIES FOR MANAGING USER-SPECIFIC WORKOUTS

BACKGROUND

In sports at any level, performance of the athlete is paramount. Not only must the athletes perform at a high level of achievement, the athletes must perform their feats at a specific time. For example, Olympic medals can only be earned at an Olympic event held once every four years. Much of sports research and development is devoted to creating technologies and regimens to ensure that the performance of an athlete "peaks" at the correct time. For example, an athlete might create training schedules, recovery routines, diets, and other schedules to ensure they are at peak performance for their specific athletic contest. To build such personalized and advanced regimens, athletes frequently rely on a large number of people to both track their progress and create new customized routines. Tracking an athlete's progress is usually done by extensively measuring a variety of parameters about the athlete.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION OF THE DRAWINGS

Figure 1:
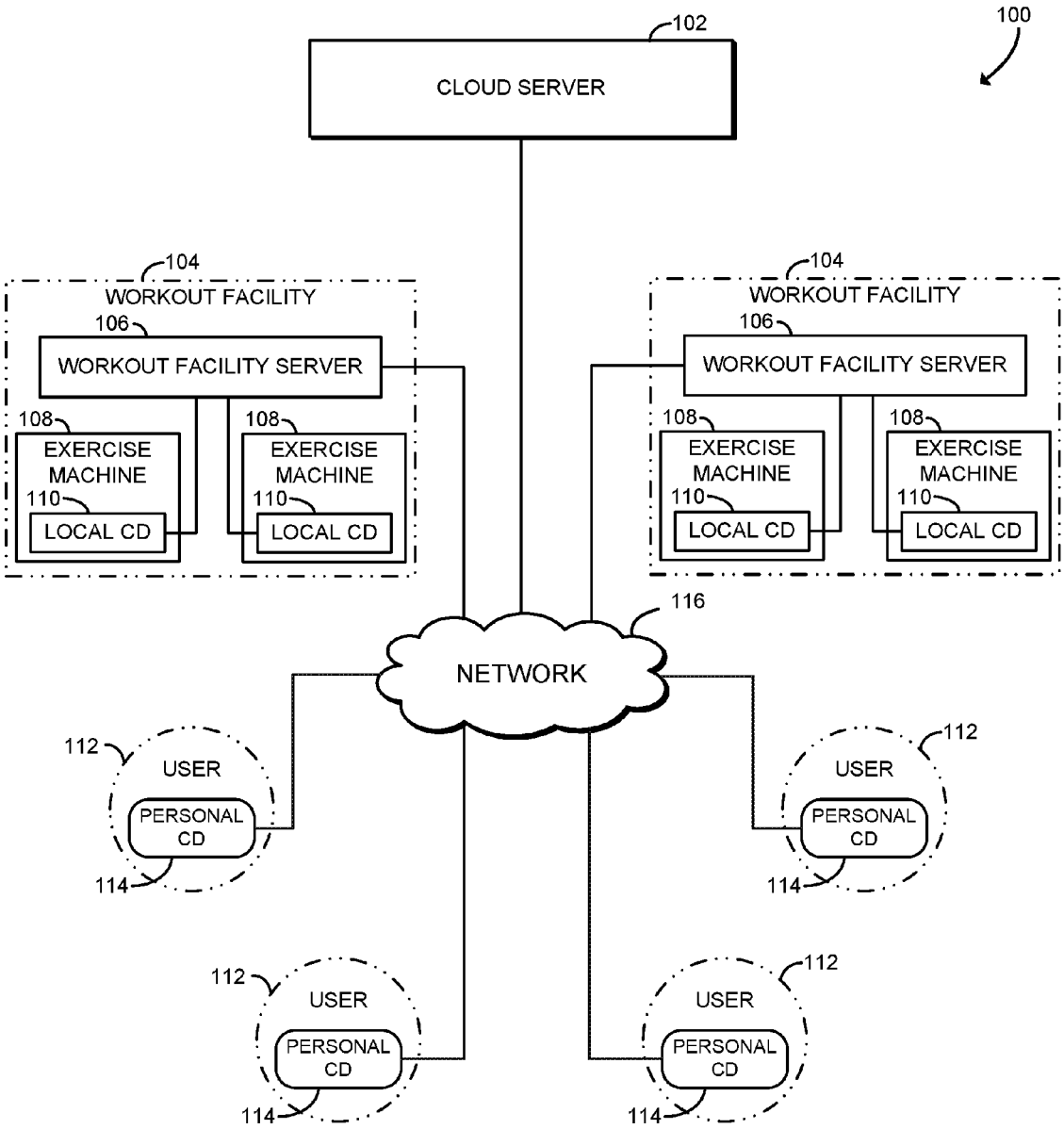
FIG. 1 is a simplified block diagram of at least one embodiment of a workout system for generating a user-specific workout plan and measuring progress of a user performing the user-specific workout plan.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

The disclosed embodiments may be implemented, in some cases, in hardware, firmware, software, or any combination thereof. The disclosed embodiments may also be implemented as instructions carried by or stored on a transitory or non-transitory machine-readable (e.g., computer-readable) storage medium, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Referring to FIG. 1, an illustrative workout system 100 is configured to generate a user-specific workout plan and track the progress of a user performing the user-specific workout plan. The system 100 includes a cloud server 102 configured to connect one or more workout facilities 104 and one or more users 112 via a network 116. As discussed in more detail below, in the illustrative workout system 100, the servers 102, 106 and the compute devices 110, 114 cooperate to generate a long-term training schedule and one or more user-specific workout plans for the user 112. The training schedule and the user-specific workout plans may be determined using medical research, the user's workout history data, the user's preferences, the user's goals, and/or information about the performance of other users completing similar workouts. In the illustrative embodiment, the user-specific workout plan is also customized based on the workout facility being used by the user 112. For example, different workout plans may be developed for workouts done at a professional gym relative to a home gym or a park.

In addition, to tailor future user-specific workout plans to meet the needs of individual users 112, the workout system 100 collects, during the workout, data about how the user 112 is performing. For example, as discussed in more detail below, sensors are positioned on each exercise machine 108 of a particular workout facility 104 to collect data about the particular exercise performed by the user 112 and how the user is performing the exercise and the overall workout plan.

Additionally, the user 112 may carry or wear one or more sensors capable of providing more information about the user's workout performance. Such personal sensors may be managed by, or included in, a corresponding personal compute device 114 carried or worn by the user. As such, the workout system 100 is configured to correlate data received from the exercise machine(s) 108 and any personal sensors worn by the user (if any) during the user's workout. In this way, the workout system 100 may combine multiple sources of information to more accurately track the progress of a user 112 through a workout routine and throughout the long-term training schedule.

The workout facility 104 may be embodied as any location that includes one or more exercise machines 108 including, for example, a commercial gym or a personal gym having one or more exercise machines 108 located in a user's home. In the illustrative embodiment, the workout facility 104 includes a workout facility server 106 configured to communicate with each exercise machine 108 and the cloud server 102 as discussed below. However, in other embodiments, the exercise machines 108 may be configured to communicate directly with the personal compute device 114 of the user 112. If included, the workout facility server 106 may be located on-site at the workout facility 104 or remote therefrom. Each exercise machine 108 may be embodied as any piece of equipment usable by a person to improve physical health through some type of motion initiated by the user and capable of performing the functions described herein. For example, an exercise machine 108 may be embodied as a treadmill, an elliptical machine, a bench press, a set of free weights, etc. In the illustrative embodiment, each exercise machine 108 in the workout facility 104 is equipped with a local compute device 110; however, in other embodiments, the workout facility 104 may include additional exercise machines that do not include a local compute device 110.

Each user 112 may possess one or more personal compute devices 114 that each is capable of connecting to the network 116 and interfacing with one or more servers (e.g., cloud server 102 and/or workout facility server 106) of the workout system 100 to perform the functions described below. In the illustrative embodiment, each personal compute device 114 is configured to interact with other components of the workout system 100 to track and improve the user's workout as discussed below. However, in other embodiments, functionality described as performed by the workout facility 104 and/or the cloud server 102 may be performed by one or more personal compute devices 114 of the user 112. That is, in some embodiments, each personal compute device 114 of the user may communicate only with the local compute device 110 of each exercise machine 108 to perform the functions described herein.

The cloud server 102, the workout facility server 106, and each local compute device 110 associated with an exercise machine 108 are configured to communicate via the network 116. The network 116 may be embodied as any type of communication network and may be configured to use any of one or more communication technology (e.g., wired or wireless communications) and associated protocols (e.g., Ethernet, Bluetooth®, Wi-Fi®, WiMAX, etc.) to effect such communication. Similarly, each of the personal compute devices 114 may use any of the one or more communication technologies discussed above to communicate directly with the local compute devices 110 of any one of the exercise machines 108.

While the illustrative embodiment of the workout system 100 includes a combination of a cloud server 102 and a workout facility server 106, it should be appreciated that some embodiments of the workout system 100 may not include both servers 102, 106. For example, in some embodiments, the functionality of the cloud server 102 and the workout facility server 106 may be embodied in a single server (e.g., either the cloud server 102 or a workout facility server 106). That is, certain functions of the workout system 100 described below may be cloud-based or contained to a local workout facility 104 depending on the particular implementation of the workout system 100.

Figure 2:
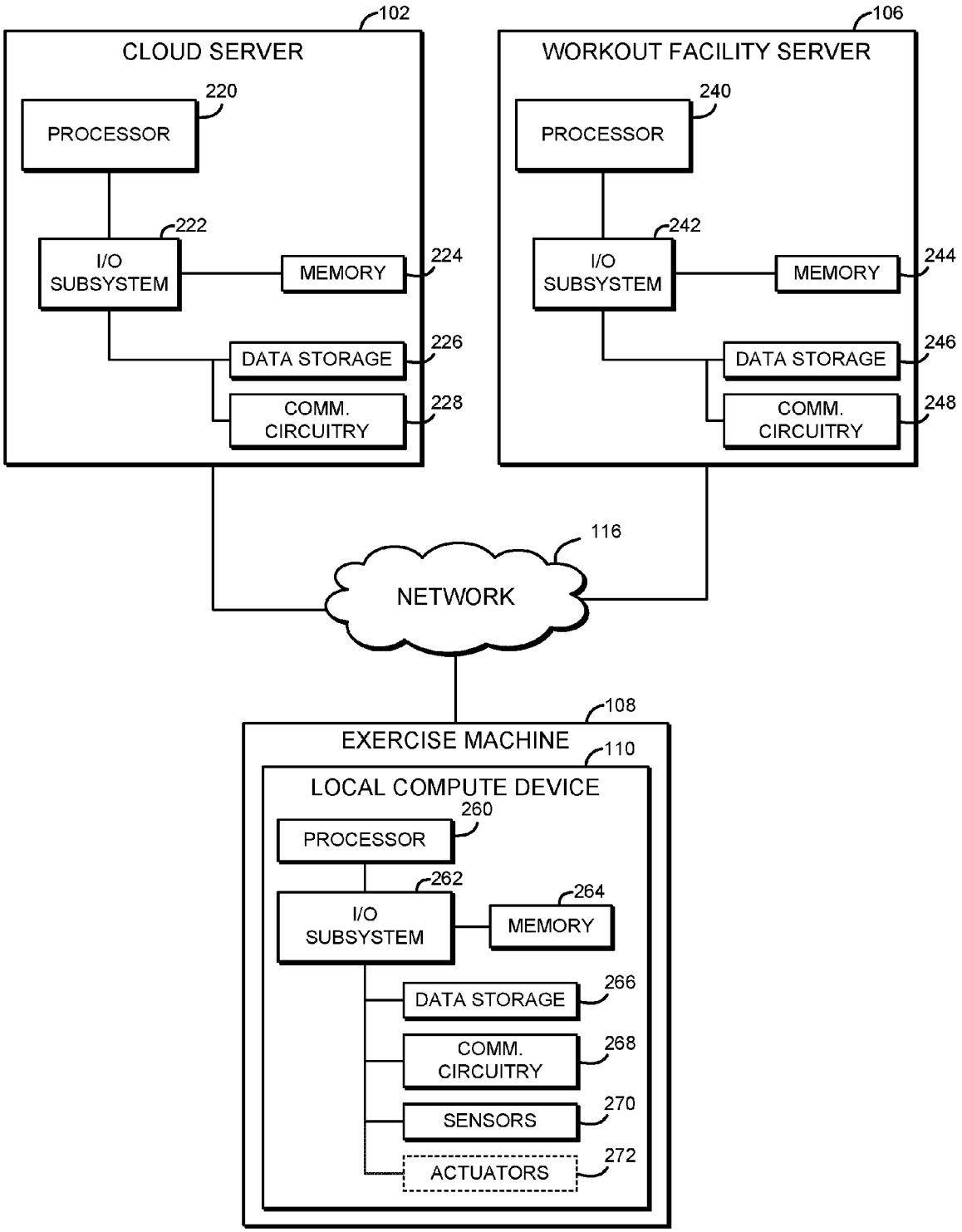
FIG. 2 is a simplified block diagram of at least one embodiment of a cloud server, one or more workout facility servers, and one or more local compute devices of the system of FIG. 1.

Referring now to FIG. 2, in use, the cloud server 102 is configured to generate a user-specific workout plan and facilitate the tracking of the progress of a user 112 performing the user-specific workout plan. The server 102 may be embodied as any type of computation or computer device capable of performing the functions described herein, including, without limitation, a server, a rack-mounted server, a blade server, a computer, a multiprocessor system, a processor-based system, a distributed computing system, a network appliance, a web appliance, a laptop computer, a notebook computer, and/or a consumer electronic device. The illustrative cloud server 102 includes a processor 220, an I/O subsystem 222, a memory 224, a data storage device 226, and communication circuitry 228. Of course, the cloud server 102 may include other or additional components, such as those commonly found in a server device (e.g., various input/output devices). Additionally, in some embodiments, one or more of the illustrative components may be incorporated in, or otherwise form a portion of, another component. For example, the memory 224, or portions thereof, may be incorporated in the processor 220 in some embodiments.

The processor 220 may be embodied as any type of processor capable of performing the functions described herein. For example, the processor 220 may be embodied as a single or multi-core processor(s), digital signal processor, microcontroller, or other processor or processing/controlling circuit. Similarly, the memory 224 may be embodied as any type of volatile or non-volatile memory or data storage capable of performing the functions described herein. In operation, the memory 224 may store various data and software used during operation of the server 102 such operating systems, applications, programs, libraries, and drivers. The memory 224 is communicatively coupled to the processor 220 via the I/O subsystem 222, which may be embodied as circuitry and/or components to facilitate input/output operations with the processor 220, the memory 224, and other components of the server 102. For example, the I/O subsystem 222 may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations. In some embodiments, the I/O subsystem 222 may form a portion of a system-on-a-chip (SoC) and be incorporated, along with the processor 220, the memory 224, and other components of the server 102, on a single integrated circuit chip.

The data storage device 226 may be embodied as any type of device or devices configured for short-term or long-term storage of data such as, for example, memory devices and circuits, memory cards, hard disk drives, solid-state drives, or other data storage devices. The data storage device 226 may store compressed and/or decompressed data processed by the server 102.

The server 102 may also include a communication circuitry 228, which may be embodied as any communication circuit, device, or collection thereof, capable of enabling communications between the server 102 and other devices of the workout system 100 over the network 116. As described above, the communication circuitry 228 may be configured to use any one or more communication technology (e.g., wired or wireless communications) and associated protocols (e.g., Ethernet, Bluetooth®, Wi-Fi®, WiMAX, etc.) to effect such communication. Of course, the cloud server 102 may include other peripheral devices as might be necessary to perform the functions of the server 102, such as displays, keyboards, other input/output devices, and other peripheral devices.

In the illustrative embodiment, the cloud server 102 is communicatively coupled to one or more workout facility servers 106 and/or one or more local compute devices 110 associated with exercise machines 108 via the network 116. However, as discussed above, the servers 102, 106 and the compute devices 110 may be communicatively coupled to one another in a different configuration in other embodiments. For example, the cloud server 102 may be communicatively coupled to the workout facility server 106 which in turn is communicatively coupled to the plurality of local compute devices 110.

Each workout facility server 106 may be embodied as any type of computation or computer device capable of performing the functions described herein, including, without limitation, a computer, a multiprocessor system, a server, a rack-mounted server, a blade server, a laptop computer, a notebook computer, a network appliance, a web appliance, a distributed computing system, a processor-based system, and/or a consumer electronic device. Each illustrative workout facility server 106 includes a processor 240, an I/O subsystem 242, a memory 244, a data storage device 246, and communication circuitry 248. Those individual components of the workout facility server 106 may be similar to the corresponding components of the cloud server 102, the description of which is applicable to the corresponding components of the workout facility server 106 and is not repeated herein so as not to obscure the present disclosure.

As discussed above, each exercise machine 108 may be embodied as any type of exercise device, such as a weight machine, treadmill, rowing machine, free weights, or the like. A typical exercise machine 108 may include a user interface (e.g., a handle, seat, bar, etc.) with which the user may interact with the exercise machine 108 to perform an exercise using the exercise machine 108. Additionally, depending on the type of exercise machine, the exercise machine 108 may include some form of a resistance generator, which may be embodied as a simple weight, the running track of a treadmill, of other device capable of providing a resistance to the user 112 of the exercise machine (e.g., to strain a muscle of the user 112) to facilitate a workout with the exercise machine 108. Additionally, as discussed above, each exercise machine 108 includes a local compute device 110, which may be embodied as any type of computation or computer device capable of performing the functions described herein, including, without limitation, a computer, a laptop computer, a notebook computer, a network appliance, a distributed computing system, a processor-based system, and/or a consumer electronic device. Each local compute device 110 includes a processor 260, an I/O subsystem 262, a memory 264, a data storage device 266, and communication circuitry 268. Those individual components of the local compute device 110 may be similar to the corresponding components of the cloud server 102, the description of which is applicable to the corresponding components of the local compute device 110 and is not repeated herein so as not to obscure the present disclosure.

Additionally, in some embodiments, each local compute device 110 may include one or more sensors 270 and one or more actuators 272. The sensors 270 may be embodied as or otherwise include any type of sensor capable of generating sensor data indicative one or more operational characteristics of the exercise machine 108. The operational characteristics may include any data indicative of the intensity of a workout performed using the particular exercise machine 108 such as the amount of resistance used (e.g., the amount of weight used, the degree of incline of a treadmill, etc.), the length of time or number of repetitions completed on the exercise machine 108, the acceleration or range of motion of various parts of the exercise machine 108, and/or other data indicative of the intensity of a workout or otherwise related to a workout performed using the particular exercise machine 108. As such, the sensors 270 may include, but are not limited to accelerometers, gyroscopes, angular position sensors, load sensor, strain gauges, speed sensor, displacement sensors, distance sensors, load cells, force transducers, and/or other sensors.

The sensors 270 may also include one or more sensors capable of measuring one or more physical parameters of the user 112 operating the exercise machine 108, such as, for example, a heartbeat monitor to monitor the heartbeat of the user 112, a weight sensor, or a breathing sensor. In this way the sensors 270 of the local compute device 110 may gather information about the workout performance of a user 112, and the local compute device 110 may aggregate the sensor data generated by the sensors 270 to generate exercise machine sensor data indicative of the workout performed.

As discussed above, each exercise machine 108 may also include one or more actuators 272. Each actuator 272 may be embodied as any device capable of modifying or adjusting an operational parameter of the exercise machine 108 such as, but not limited to, linear actuators, stepper motors, hydraulic pistons, and/or other controllable adjustment devices. The operational parameters controlled by the actuators 272 may include any parameter of the exercise machine 108 that affects a workout performed on the exercise machine 108. For example, the operational parameters may include the exercise weight of a weight machine, the incline of a treadmill, the position of a seat, handle, or bench of the exercise machine 108, and/or other parameters, functions, or settings of the exercise machine 108.

Figure 3:
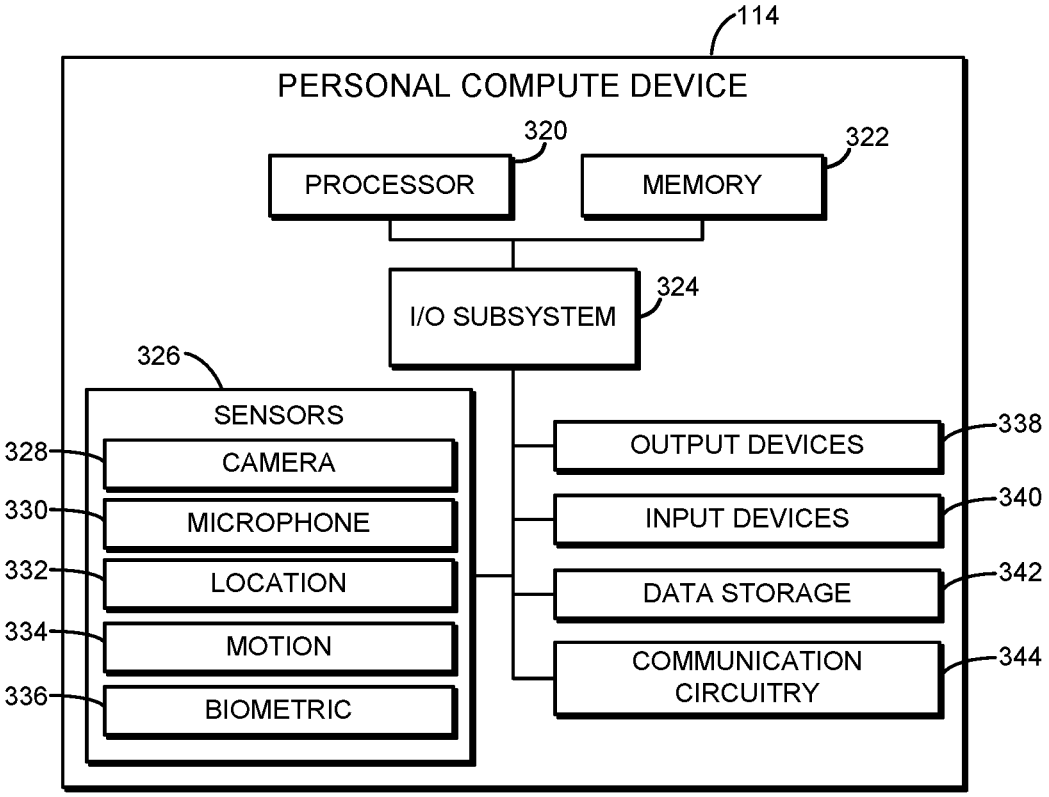
FIG. 3 is a simplified block diagram of at least one embodiment of a personal compute device of the system of FIG. 1.

Referring now to FIG. 3, each personal compute device 114 may be embodied as any type of compute device capable of being worn or carried by a user 112 and performing the functions described herein. For example, each personal compute device 114 may be embodied as a wrist-wearable compute device, smart clothing, an implantable compute device, a smart ring, smart glasses, a smartphone, a table computer, a notebook computer, a laptop computer, a mobile compute device, a computer, a multiprocessor system, a processor-based system, a consumer electronic device, or other wearable or mobile compute device capable of monitoring physical characteristics of the user 112. In some embodiments, the personal compute device 114 may be of a distributed form and include multiple, individual personal compute devices that communicate with each other. For example, the user 112 may wear smart clothing and have a smart watch, each of which communicate with a smartphone of the user to perform the functions described herein.

Illustratively, each personal compute device 114 includes a processor 320, an I/O subsystem 324, a memory 322, a data storage device 342, and communication circuitry 344. Those individual components of the illustrative personal compute device 114 of FIG. 3 may be similar to the corresponding components of the cloud server 102, the description of which is applicable to the corresponding components of the personal compute device 114 and is not repeated herein so as not to obscure the present disclosure.

Each personal compute device 114 also includes one or more sensors 326 configured to measure one or more physical characteristics or conditions of the user 112 during a workout and, in some cases, during non-workout time periods. The sensors 326 may be embodied as any type of sensor capable of generating sensor data indicative of a physical characteristic or condition of the user 112 including, but not limited to, a motion of the user 112, a location of the user 112, a biometric measurement of the user 112, a stress level of the user 112, a perspiration level of the user 112, and/or other physical characteristic or condition of the user 112 during workout and/or non-workout periods. For example, in the illustrative embodiment, the sensors 326 include one or more cameras 328, microphones 330, location sensors 332, motion sensors 334, and biometric sensors 336. Of course, the sensors 326 may include different or additional sensors in other embodiments.

The camera(s) 328 may be embodied as any type of image capturing device capable of capturing an image of the user. As such, the sensor data generated by the camera 328 may be used to monitor the user for signs of exertion during a workout. The microphone 330 may be embodied as any type of audio capturing device capable of capturing vocal sounds produced by the user. As such, the sensor data generated by the microphone(s) 330 may also be used to monitor the user for signs of exertion during a workout (e.g., based on breathing patterns or vocalized stress). The location sensor (s) 332 may be embodied as any type of sensor, circuit, or device, such as a global positioning system (GPS) circuit, capable of generating sensor data indicative of a present location of the personal compute device 114. Such location data may be utilized by the workout system 100 to initiate a workout routine. For example, the personal compute device 114 may be configured to automatically send a workout request to one of the servers 102, 106 in response to a determination, based on the location sensor data, that the user 112 is located at one of the workout facilities 104. Additionally, the location sensor data may be utilized by the workout system 100 to determine, in part, which exercise machine 108 the user 112 is currently operating.

The motion sensor(s) 334 may be embodied as any type of sensor or circuit capable of generating sensor data indicative of a motion of the user 112 (e.g., the body or a limb of the user 112). For example, the motion sensor 334 may be embodied as one or more accelerometers to generate motion data indicative of a motion of the user 112. In such embodiments, the accelerometers may be positioned on the body of the user 112 in various locations to measure different movements of the user 112. For example, the motion sensors 334 may include an accelerometer incorporated into a smart watch worn by the user 122 and configured to monitor the movements of one of the arms of the user 112. It should be appreciated that such wearable technology allows the motion sensors 334 to be positioned nearly anywhere on the body of the user 112 and may be integrated into the clothing of the user 112, in some embodiments.

The biometric sensors 336 may be embodied as any type of sensor capable of measuring one or more physiological and/or cognitive responses of the user 112 during a workout. For example, the biometric sensors 336 may be embodied as, or otherwise include, a heart rate monitor to measure the user's heart rate, a sensor to measure brain activity, a temperature sensor to measure the temperature of the user 112, a perspiration sensor to monitor a level or perspiration of the user 112, and/or other biometric sensor.

The personal compute device 114 may also include one or more output devices 338 and/or input devices 340. The output device(s) 338 may be embodied as any type of device capable of generating an output such as, for example, a display, speaker, motion actuator, tactile device, touchscreen, and/or other output device. Similarly, the input device(s) 340 may be embodied as any type of device capable of receiving input from the user such as, for example, a touchscreen display, a keyboard, a microphone, a touchpad, buttons, speech recognition hardware/software, gesture recognition hardware/software, eye tracking hardware/software, a brain-computer interface, and/or other input device.

Figure 4:
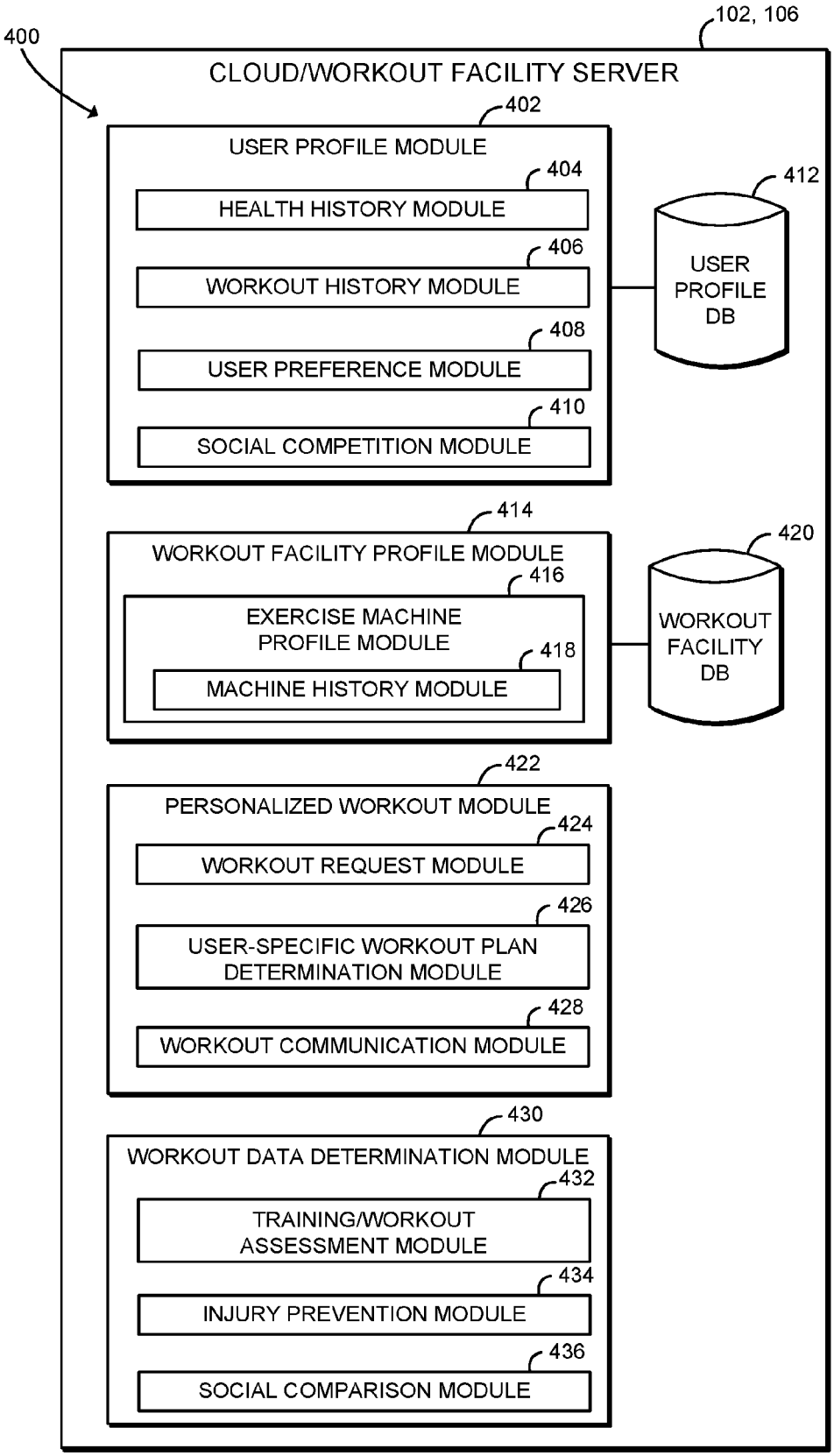
FIG. 4 is a simplified block diagram of at least one embodiment of an environment that may be established by one or more of the servers of FIG. 2.

Referring to FIG. 4, as discussed above, the cloud server 102 and the workout facility servers 106 cooperate to generate a long-term training schedule, one or more user-specific workout plans, and monitor the workout performed by the user 112 based on sensor data received from the exercise machines 108 and/or personal compute devices 114. The cloud server 102 and the workout facility servers 106, either alone or in combination, are configured to establish the environment 400 during operation. In some embodiments, the environment 400 is established by both the cloud server 102 and one or more workout facility server 106 in combination; but, in other embodiments, the environment 400 may be established by only one the cloud server 102 or the workout facility server 106. The illustrative environment 400 includes a user profile module 402, a workout facility profile module 414, a personalized workout module 422, and a workout data determination module 430.

The various modules of the environment 400 may be embodied as hardware, software, firmware, or a combination thereof. For example, the various modules, logic, and other components of the environment 400 may form a portion of, or otherwise be established by, the processor 220, 240 or other hardware components of the cloud server 102 and/or workout facility server 106. As such, in some embodiments, one or more of the modules of the environment 400 may be embodied as circuitry or collection of electrical devices (e.g., a user profile circuitry 402, a workout facility profile circuitry 414, a personalized workout circuitry 422, and a workout data determination circuitry 430). It should be appreciated that, in such embodiments, one or more of the user profile circuitry 402, the workout facility profile circuitry 414, the personalized workout circuitry 422, and the workout data determination circuitry 430 may form a portion of one or more of the processor 220, 240, the I/O subsystem 222, 242, the memory 224, 244, the data storage 226, 246, and/or communication circuitry 228, 248. Additionally, in some embodiments, one or more of the illustrative modules may form a portion of another module and/or one or more of the illustrative modules may be independent of one another.

The user profile module 402 is configured to store and update user profile data related to individual users 112 of the workout system 100. The user profiled data managed by the user profile module 402 may be embodied as any type of information related to a user and useful in generating a user-specific workout plan as discussed in more detail below. For example, the user profile data may be embodied as or otherwise include information about the physical characteristics of the user 112 (e.g., height, weight, age, gender, medical conditions, etc.), past workout information related to workouts performed by the user (e.g., workouts completed, performance metrics of the workout, workout times and durations, injuries, etc.), and/or user preferences (e.g., preferred exercises, disfavored exercises, preferred workout facilities, etc.). The user profile module 402 may store the user profile data in the user profile database 412, which is illustratively included in the server 102, 106. However, in other embodiments, the user profile database 412 may be remote from the servers 102, 106 and accessible thereby via one or more networks. Illustratively, the user profile module 402 includes a health history module 404, a workout history module 406, a user preference module 408, and a social competition module 410. Although each of the modules 404, 406, 408, 410 are discussed below in regard to a single user, it should be appreciated that the user profile module 402 of the servers 102, 106 is configured to store information about multiple users of the workout system 100.

The health history module 404 is configured to manage and update heath data related to the user 112. The heath data of the user 112 may be embodied as any type of data indicative of a health characteristic of the user (e.g., physical characteristics, diet, injuries, etc.) Additionally, in the illustrative embodiment, the health data includes one or more goals of the user 112, which may relate to one or more of the health characteristics. For example, the health data may include physical characteristics of the user 112 such as height, weight, age, gender, and/or other body measurements of the user 112 and the related goal data may include a goal weight or body measurement. The health data managed by the health history module 404 may also include information about one or more conditions that might affect the user's performance during a workout, such as an injury or a disease or disorder which might affect the performance of the user 112. Additionally, in some embodiments, the health history module 404 is configured to store information about the health of the user 112 when the user 112 is not exercising. For example, the health history module 404 may be configured to store information about daily food intake of the user 112, or may be configured monitor the physical activity (e.g., the number of steps taken by the user 112) when the user 112 is not exercising. As discussed in more detail below, the health data managed by the health history module 404 may be used to generate a more personalized workout plan and/or more accurately interpret data measured during a user's workout.

The workout history module 406 is configured to store and manage workout history data indicative of one or more past workouts performed by the user 112. The workout history data managed by the workout history module 406 may include any type of information related to workouts performed by the user 112 such as the identity of past workouts performed, the level of exertion done during workouts, and other information related to such workouts.

The user preference module 408 is configured to store and manage preference data indicative of one or more preferences of the user 112. As discussed above, such preference data may include, for example, preferred exercises, disfavored exercises, preferred workout facilities, short and long-term goals (e.g., a weight goal, a blood pressure threshold goal), etc. Such preference data may be used by the workout system 100 to develop a long-term training schedule and user-specific workout plans customized for the user.

The social competition module 410 is configured to manage workout history data for a pool of users similar to the user 112 and generates social competition data based on a comparison of the user's performance during workouts and the performance of other users (e.g., a baseline indicative of the average performance). It should be appreciated that competition with another person may motivate the user the user 112 to exercise more, harder, or longer. As such, in the illustrative embodiment, the social competition module 410 is configured to anonymously compare the user 112 to other similar users based on the user profile data and the workout data determined for each individual. For example, the social competition module 410 may compare the user 112 to other users having similar ages, genders, and weights, as indicated by the user profile data of each user 112. As the user 112 utilizes the workout system 100 more, the social competition module 410 may be configured to refine the comparisons further by comparing the user 112 to individuals with similar workout results or performances, similar workout preferences, or other users who are located close the user 112. In some embodiments, the social competition module 410 compares the user 112 to other users anonymously, but, in other embodiments, the user 112 may be informed of the identity of the other users being compared. For example, in some embodiments, the user 112 may be able to instruct the workout system 100 to compare the user's performance to the performance of a friend. In this way, both users of the workout system 100 will know who their performance is compared against.

The workout facility profile module 414 is configured to collect, store, and manage workout facility profile data, which may be embodied as any information related to a particular workout facility 104 (e.g., identify information, resource information, etc.). As discussed above, the workout facilities 104 may be embodied as a professional gym, a personal gym of the user found in the user's home, or a public place such as a park that may include exercise equipment. In the illustrative embodiment, the workout facility profile data includes information regarding the exercise machines 108 located at the workout facility 104. Additionally, the workout facility profile data may identify those exercise machines 108 that are equipped with local compute devices 110, including sensors 270. For example, at a professional workout facility, exercise equipment 108 such as a set of free weights may not have local compute devices 110 positioned thereon, while other exercise machines 108 do, such as the treadmills. Such information may be used to develop the user-specific workout plan, which may include the "smart" exercise equipment as well as the "dumb" exercise equipment. In some embodiments, the workout facility profile data also includes information regarding the layout of the gym and, as such, may be configured to optimize the user-specific workout plan to minimize movement of the user 112 to perform the various exercises of the user-specific workout plan. Additionally, in some embodiments, the workout facility profile data may include information indicating which exercise machines 108 are currently in use at the workout facility 104. Further, in some embodiments, the workout facility profile data may include data indicative of whether the workout facility is a membership-based gym.

The illustrative workout facility profile module 414 includes an exercise machine profile module 416, which may manage information about exercise machines located in the particular workout facility. For example, the exercise machine profile module 416 may manage exercise machine data that identifies a type of the exercise machine 108 and whether the exercise machine 108 is equipped with one or more sensors 270 as discussed above. The exercise machine data may also be indicative of the performance of each exercise machine 108. Over time the performance of any particular exercise machine 108 may change or degrade. As such, the performance data of a particular exercise machine 108 may be used by the user 112 to better use the articular exercise machine 108 and, in some embodiments, such performance data allows the owner/proprietor of the workout facility 104 to track the wear and tear of the exercise machines 108. The exercise machine profile module 416 includes a machine history module 418 that generates exercise machine history data indicative of the past exercises performed on the machine.

The workout facility profile module 414 may store the workout facility profile data, including any excise machine data, in a workout facility database 420, which is integrated with the servers 102, 106 in the illustrative embodiment. However, in other embodiments, the workout facility database 420 may be remote from the servers 102, 106 but communicatively coupled thereto via one or more networks.

The personalized workout module 422 is configured to generate a long-term training schedule and one or more user-specific workout plans for the user 112 based on the user profile data and the workout facility data discussed above. To do so, the personalized workout module 422 includes a workout request module 424, a user-specific workout plan determination module 426, and a workout communication module 428. The workout request module 424 is configured to receive a workout request initiated by the user 112. In the illustrative embodiment, the workout request is initiated by the personal compute device 114 in response to inputs entered by the user 112 (or automatically based on the present location of the user 112), and is transmitted to the servers 102, 106 via the network 116. As discussed below, such workout requests may include data that identifies a workout facility and user identification information. In the illustrative embodiment, the servers 102, 106 utilize the user identification information to retrieve the user profile data associated with the user 112. Additionally, the servers 102, 106 utilize the workout facility identification data to retrieve the workout facility profile data associated with the particular workout facility 104. In other embodiments, the workout request may directly include the user profile data and/or the workout facility profile data, rather than identification information usable to retrieve each.

The user-specific workout plan determination module 426 is configured to generate a user-specific workout plan for the user 112. The user-specific workout plan identifies one or more exercises to be performed by the user 112, some of which may be performed using one or more exercise machines 108 included at the particular workout facility 104. The user-specific workout plan determination module 426 generates the user-specific workout plane based on the user profile data and the workout facility data. For example, the user-specific workout plan determination module 426 may determine the current needs of the user 112 and which types of workouts the chosen workout facility 104 is capable of delivering. For example, if the user's long-term training schedule requires that the user 112 perform an aerobic workout, such as running, and the user 112 is at a professional gym, the user-specific workout plan may include using the treadmills and ellipticals found at the professional gym. In another example, assuming again that the user 112 desires to perform an aerobic workout, but this time the user 112 is at a park, the user-specific workout plan might lay out a route around the park and the neighboring areas for the user 112 to run.

In some embodiments, the user-specific workout plan determination module 426 may rely on additional information beyond the user profile data and the workout facility profile data to generate the user-specific workout plan. For example, the user-specific workout plan determination module 426 may rely on medical research and the user's goals to develop the user-specific workout plan.

In the illustrative embodiment, the user-specific workout plan determination module 426 may also generate a long-term training schedule for the user based on the user profile data and the workout facility profile data. The long-term training schedule may be based on the goals the user and the present physical conditioning of the user. For example, if the user 112 desires to run a marathon, the user-specific workout plan determination module 426 may develop training schedule that gradually builds up the user's ability to run long-distances and helps the user 112 peak at the selected time for the marathon. Many of the long-term training plans may involve training for a specific event, such as training for an athletic contest like a marathon or training to lose weight in preparation for a wedding.

In some embodiments, the user-specific workout plan determination module 426 may rely on additional information beyond the user profile data and the workout facility profile data to generate the user-specific workout plan. For example, when developing the long-term training schedule and the daily/periodic user-specific workout plans, the user-specific workout plan determination module 426 may utilize information developed by medical research to optimize the performance of the user 112. Additionally, to more effectively use medical research to help each individual user 112, the user-specific workout plan determination module 426 also includes a workout communication module 428 configured to receive feedback about the user 112 and the user's performance during a workout from the sensors 270, 326. The information from the sensors 270, 326 is necessary to produce an accurate picture of how the user 112 is performing. Based on the user's past performance of previous workout plans and the long-term training schedule, the next user-specific workout plan may be personalized to best help the user 112 achieve the user's goals. Additionally, during a workout, information from the sensors 270 of the exercise machines 108 and/or the sensors 326 of the personal compute device 114 of the user 112 may be used to adjust the workout plan based on the performance of the user.

The workout communication module 428 may also be configured to link the personal compute device 114 associated with the user 112 and the local compute device 110 of the exercise machine 108 being operated by the user 112. The linking of the two compute devices 110, 114 allows the servers 102, 106 to correlate the data received from the two different sources to the same user 112 and the same workout, which may be needed in those cases in which multiple users 112 working out in the same monitored facility 104. The personal compute device 114 may be linked or connected to the local compute device 110 of an exercise machine 108 through a variety of methods. For example, the personal compute device 114 may be linked to the local compute device 110 at the server level. For example, the personal compute device 114 may scan an exercise machine identification tag attached to the exercise machine 108 before exercising. By so doing this, the servers 102, 106 can correlate the exercise machine sensor data from the exercise machine 108 with the user 112. Additionally or alternatively, the personal compute device 114 may be connected to the local compute device 114 of an exercise machine 108 through a physical electrical connection, such as a wire, or through a wireless communication connection, such as WiFi or Bluetooth. In other embodiments, the exercise machine 108 is equipped with another type of scanner, such as, a bar code scanner or a QR code scanner that is configured to read an associated user identification tag generated by an output device 338 of the personal compute device 114.

The workout data determination module 430 is configured to generate workout data indicative of a workout performed by the user 112. For example, the workout data may include data related to one or more exercises performed by the user 112 (e.g., intensity level, duration, overall performance grade, etc.). In the illustrative embodiment, the workout data determination module 430 determines the workout data based on the exercise machine sensor data generated by the sensors 270 of the exercise machine 108 and the user sensor data generated by the sensors 326 of the personal compute device 114 of the user 112. As such, the workout data provides feedback to the user 112 about the performance of the user 112 during the relative exercise. As discussed below, the workout data is used by the workout system 100 to reassess both long-term training schedules and workout plans of the user, prevent injury to the user, and compare the user 112 to other individuals who are also using the workout system 100.

The illustrative workout data determination module 430 includes a training/workout assessment module 432, an injury prevention module 434, and a social comparison module 436. The training/workout assessment module 432 is configured evaluate the progress of the user 112, based on the workout data, in performing the training schedule and in performing individual workout plans. In the illustrative embodiment, the training/workout assessment module 432 determines health progress data of the user 112 indicative of a temporal-based change in a fitness level of the user. The health progress data may be included in the workout data and may be based on sensor data that indicates whether the user 112 is meeting or exceeding health expectations based on the long-term training schedule. For example, if the user 112 is training to run a marathon within a particular time, the health progress data may provide an indication whether the performance of the user 112 during current workouts, based on the long-term training schedule, will result in the user 112 meeting the user's goals. Depending on how the user 112 is performing on the training schedule, the training/workout assessment module 432 may be configured to adjust the training schedule. In one example, the training schedule may be accelerated in response to a determination that the user 112 is exceeding planned expectations and new goals may be suggested for the user 112. In another example, the training/workout assessment module 432 may be configured to adjust the training schedule and daily workout plans to account for setbacks in the user's performance, such as injury. Additionally, in some embodiments, the training/workout assessment module 432 uses the workout data to adjust daily workout plans being performed by the user 112. For example, if the workout data indicates that the user 112 is not meeting performance expectations for the daily workout plan, the training/workout assessment module 432 may be configured to adjust the workout plan (e.g., in real time) to better help the user 112 achieve the user's goals. Further, in some embodiments, the training/workout assessment module 432 may be configured to actively control the exercise machines 108 operated by the user 112 to adjust one or more operating parameters of the exercise machine 108 based on the performance of the user 112 (e.g., by transmitting a control signal to the local compute device 110 of the exercise machine 108.

The injury prevention module 434 is configured to determine risk data indicative of a risk of injury of the user 112 while the user 112 is performs an exercise. For example, in the illustrative embodiment, the injury prevention module 434 uses the workout data to determine the user's motion during an exercise. The injury prevention module 434 may contemporaneously compare the user's motion to a preferred exercise motion for the particular exercise. Based on the differences between the user's motion and the preferred exercise motion, the injury prevention module 434 may determine the user's risk of injury. In this way, the workout data is may be used to prevent repetitive use injuries that may be caused by incorrectly performing workouts. In some embodiments, the injury prevention module 434 may also be able to detect potential injuries forming based on regressions in the user's motion. That is, before an injury is completely apparent, a user 112 may compensate for pain by slightly changing an exercise motion. Often this is done subconsciously by the user 112. As such, by detecting and monitoring changes in the user's exercise motion over time, the injury prevention module 434 may be configured to alert the user about potential injuries forming.

The social comparison module 436 is configured to compare the user's workout data to the workout data of other individuals also utilizing the workout system 100 and generate social competition data. The social competition data compares one or more recent workouts of the user 112 to one or more recent workouts of other uses of the workout system 100. As discussed above, the user 112 may be anonymously compared to other users with similar characteristics, such as, similar gender, height, and weight or may be compared to a requested user (e.g., a friend).

Figure 5:
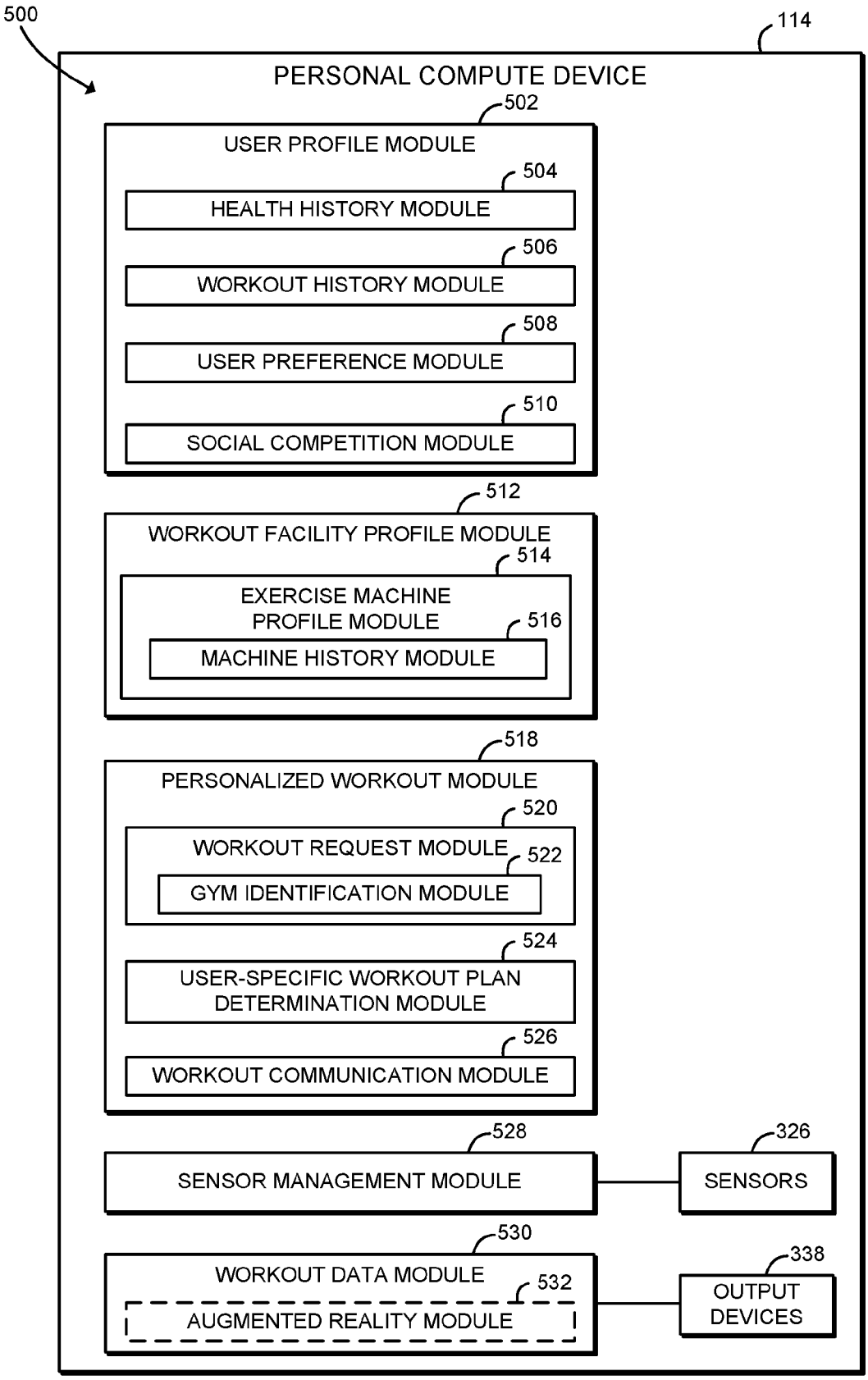
FIG. 5 is a simplified block diagram of at least one embodiment of an environment that may be established by the personal compute device of FIG. 3.

Referring now to FIG. 5, the personal compute device 114 is configured to establish an environment 500 during operation. In some embodiments, the personal compute device 114 is configured to establish an environment similar to, or including, the environment 400 as discussed above in regard to FIG. 4 and perform the functions described therein. In such embodiments, the personal compute device 114 communicates directly with each workout facility 104 and/or directly with each exercise machine 108 to collect workout data and generate training schedules and workout plans. As such, many of the modules of the environment 500 of the personal compute device 114 discussed below have similar names to modules discussed above in regard to the environment 400 of FIG. 4 and may embodied similarly. As such, a full description of the functionality of those modules and features is not repeated herein for clarity of the description. However, in other embodiments, the personal compute device 114 cooperates with one or more servers (e.g., the cloud server 102 or a workout facility server 106) to perform various functions of the workout system 100.

The illustrative environment 500 includes a user profile module 502, a workout facility profile module 512, a personalized workout module 518, a sensor management module 528, and workout data module 530. The various modules of the environment 500 may be embodied as hardware, software, firmware, or a combination thereof. For example, the various modules, logic, and other components of the environment 500 may form a portion of, or otherwise be established by, the processor 320 or other hardware components of the personal compute device 114. As such, in some embodiments, one or more of the modules of the environment 500 may be embodied as circuitry or collection of electrical devices (e.g., a user profile circuitry 502, a workout facility profile circuitry 512, a personalized workout circuitry 518, a sensor management circuitry 528, and workout data circuitry 530). It should be appreciated that, in such embodiments, one or more of the user profile circuitry 502, the workout facility profile circuitry 512, the personalized workout circuitry 518, the sensor management circuitry 528, and/or the workout data circuitry 530 may form a portion of one or more of the processor 320, the I/O subsystem 324, the memory 322, the data storage 342, the communication circuitry 344, the sensors 326, and/or communication circuitry 344. Additionally, in some embodiments, one or more of the illustrative modules may form a portion of another module and/or one or more of the illustrative modules may be independent of one another.

The user profile module 502 is configured to store and manage the user profile data for the individual user 112 associated with the personal compute device 114. As with the user profile module 402, the user profile module 502 illustratively includes a health history module 504, a workout history module 506, a user preference module 508, and a social competition module 510, each of which function similar to the corresponding modules of the user profile module 402. In use, as discussed above, the user profile module 502 generates user profile data based on health data, workout history data, user preference data, and/or social competition data generated by their respective modules.

The workout facility profile module 512 is configured to collect, store, and manage workout facility profile data. As with the workout facility profile module 414, the workout facility profile module 512 illustratively includes an exercise machine profile module 514, which further includes an exercise machine profile module, each of which function similar to the corresponding modules of the workout facility profile module 414. In use, the workout facility profile module 512 manages information related to one or more workout facility 104 (e.g., identify information, resource information, etc.) as discussed above.

The personalized workout module 518 of the environment 500 is configured to generate a user-specific workout plan based on the user profile data and the workout facility profile data. In some embodiments, the personalized workout module 518 may also determine a long-term training schedule, which may be used with the user profile data to determine one or more user-specific workout plans as discussed above in regard to the personalized workout module 422 of the environment 400.

The illustrative personalized workout module 518 includes a workout request module 520, a user-specific workout plan determination module 524, and a workout communication module 526. The workout request module 520 is configured to generate a workout request in response to one or more actions performed by the user 112. For example, workout request may be generated in response to a user's manual initiation or may be automatically generated in response to the user entering a workout facility 104 (e.g., based on the location sensor data generated by the location sensor 332 of the personal compute device 114). In the illustrative embodiment, the work request is transmitted to the workout facility server 106 and/or the cloud server 102. To do so, the workout request module 520 includes a gym identification module 522 configured to determine which workout facility 104 the user 112 is presently located in or likely to use to perform a workout. For example, the gym identification module 522 may identify the workout facility 104 based on the sensor data from the location sensors 332 and, in some embodiments, may predict the workout facility 104 based on a determination of the nearest workout facility 104 or historical workout data. The gym identification module 522 may include identification of the determined workout facility 104 in the workout request.

The user-specific workout plan determination module 524 is configured to generate user-specific workout plans based on the user profile data and the workout facility profile data. In some embodiments, the user-specific workout plan determination module 524 is also configured to determine a long-term training schedule to assist the user 112 in achieving long-term achievements, such as, running a marathon on a certain day or losing so much by a certain date. The user-specific workout plan determination module 524 is similarly embodied to the user-specific workout plan determination module 426 of the environment 400 and performs in a similar manner as discussed in detail above in regard to the user-specific workout plan determination module 426.

The workout communication module 526 is configured to allow the personal compute device 114 to communicate with any one or more of the cloud server 102, a workout facility server 106, or a local compute device 110 of an exercise machine 108 via any suitable type of network 116. Specifically, the workout communication module 526 is configured to allow communication between the various components of the workout system 100 during a workout correlates any data received from a local compute device 110 of an exercise machine 108 with the user profile of the user 112 associated with the personal compute device 114 (e.g., to identify the user and/or which exercise machine 108 the user is currently using, as discussed above.)

The sensor management module 528 is configured to manage the sensors 326 of the personal compute device 114. For example, the sensor management module 528 may receive and aggregate the sensor data from each of the sensors 326 and transmit such data to the one or more of the servers 102, 106 via the network 116 as discussed above.

The workout data module 530 is configured to manage the workout data generated during the workout of the user 112. In some embodiments, the workout data module 530 generates workout data based on exercise machine sensor data received from one or more exercise machines 108 and/or sensor data generated by one or more sensors 326 of the personal compute device 114. As such, the workout data module 530 may be similarly embodied as the workout data determination module 430 discussed above and function in a similar manner. However, in other embodiments, the personal compute device 114 may receive the workout data from either the cloud server 102 or the workout facility server 106, rather than locally generate such data. Regardless, the workout data module 530 may be configured to provide the workout data to the user via the one or more output devices 338.

To facilitate providing workout data and related information to the user 112, the workout data module 530 may include an augmented reality module 532 configured to create an augmented gym with exercise guidance. For example, the augmented reality module 532 may be configured generate an avatar, or an augmented reality personal assistant, for the user 112. The avatar may be configured to show the user 112 how to perform certain exercises or how different training schedules and health regimens are likely affect the user's health. For example, the augmented reality module 532 may create a simulation where the application will allow the user 112 to manipulate parameters such as exercise type and intensity levels, and use the avatar to represent how those types of workouts will affect the user 112 over time. Similarly, the augmented reality module 532 may be configured to visually map a workout facility 104.

Figure 6:
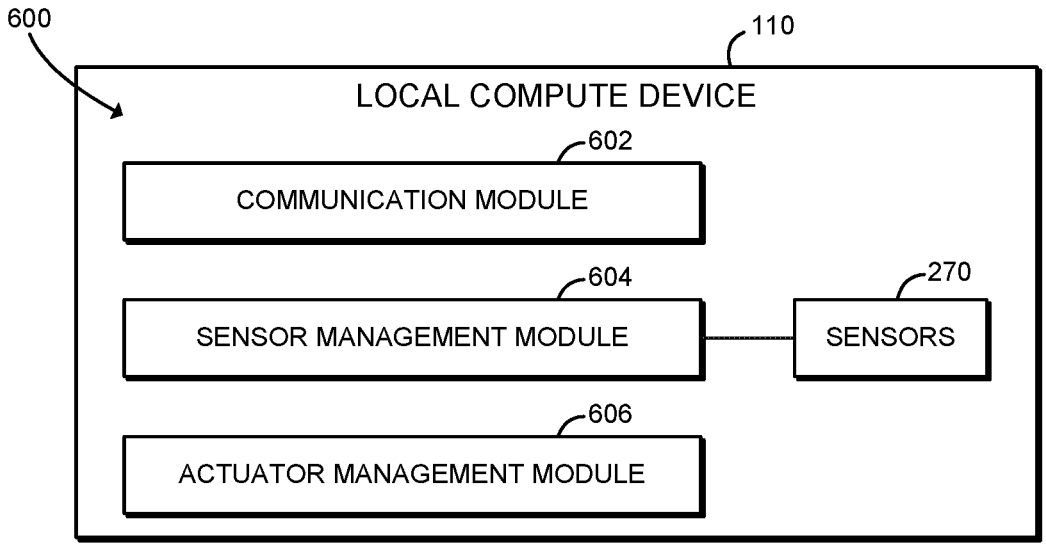
FIG. 6 is a simplified block diagram of at least one embodiment of an environment that may be established by the local compute device of FIG. 2.

Referring to FIG. 6, each local compute device 110 of each exercise machine 108 is configured to establish an environment 600 during operation. As discussed below, each local compute device 110 is configured to generate exercise machine sensor data based on one or more operational characteristics of the corresponding exercise machine 108 during performance of an exercise by the user 112 on the exercise machine 108 and transmit the exercise machine sensor data to either the cloud server 102, one or more of the workout facility servers 106, and/or one or more of the personal compute devices 114 in the workout system 100 depending on the particular embodiment. Additionally, in some embodiments, the local compute device 110 may receive adjustment commands to adjust one or more operational parameters of the exercise machine 108 using the one or more actuators 272.

The illustrative environment 600 includes a communication module 602, a sensor management module 604, and an actuator management module 606. The various modules of the environment 600 may be embodied as hardware, software, firmware, or a combination thereof. For example, the various modules, logic, and other components of the environment 600 may form a portion of, or otherwise be established by, the processor 260 or other hardware components of the local compute device 110. As such, in some embodiments, one or more of the modules of the environment 600 may be embodied as circuitry or collection of electrical devices (e.g., a communication circuitry 602, a sensor management circuitry 604, and an actuator management circuitry 606). It should be appreciated that, in such embodiments, one or more of the communication circuitry 602, the sensor management circuitry 604, and the actuator management circuitry 606 may form a portion of one or more of the processor 260, the I/O subsystem 262, the memory 264, the data storage 266, the communication circuitry 268, and/or the sensors 270. Additionally, in some embodiments, one or more of the illustrative modules may form a portion of another module and/or one or more of the illustrative modules may be independent of one another.

The communication module 602 is configured to facilitate communications between the local compute device 110 and the cloud server 102, one or more workout facility servers 106, and/or one or more personal compute devices 114. For example, in some embodiments, the communication module 602 may be configured to establish, based on operation of the corresponding exercise machine 108 by the user 112, a communication link with the personal compute device 114 of the user 112. The communication module 602 may be configured to use any one or more communication technology (e.g., wired or wireless communications) and associated protocols (e.g., Ethernet, Bluetooth®, Wi-Fi®, WiMAX, etc.) to effect such communication.

The sensor management module 604 is configured to receive sensor data from the one or more sensors 270 and generate exercise machine sensor data based on the sensor data. The exercise machine sensor data is indicative of operational characteristics of the corresponding exercise machine 108 while the user 112 performs an exercise on the exercise machine 108. For example, the exercise machine sensor data may provide an indication the intensity of the workout, the length of the workout, the amount of weight used, the speed of movements, and/or other data related to the operation of the exercise machine 108 by the user 112. The sensor management module 604 may transmit, via the communication module 602, the exercise machine sensor data to the servers 102, 106 and/or the personal compute device 114 via the network 116.

The actuator management module 606 is configured to adjust one or more operational parameters of the exercise machine 108 based on operational data received from the personal compute device 114 and/or servers 102, 106. The operational data defines at least one operational parameter of the exercise machine 108 that may be adjusted (e.g., commands to adjust various physical structures of the exercise machine 108). In some embodiments, the operational data is included in the user-specific workout plan, which may be received from the personal compute device 114 and/or servers 102, 106. The actuator management module 606 may adjust the operational parameters of the exercise machine 108 by adjusting one or more physical structures of the exercise machine 108 via one or more of the actuators 272 based on the operational parameters of the operational data. In some embodiments, the actuator management module may be configured to adjust the operational parameters of the exercise machine 108 without direction from the user 112 based on the operational data (e.g., to automatically adjust the exercise machine 108 in preparation for a workout by the user 112). In some embodiments, the operational data may include data received from an input device integrated into the exercise machine 108 based on a user selection.

Figure 7:
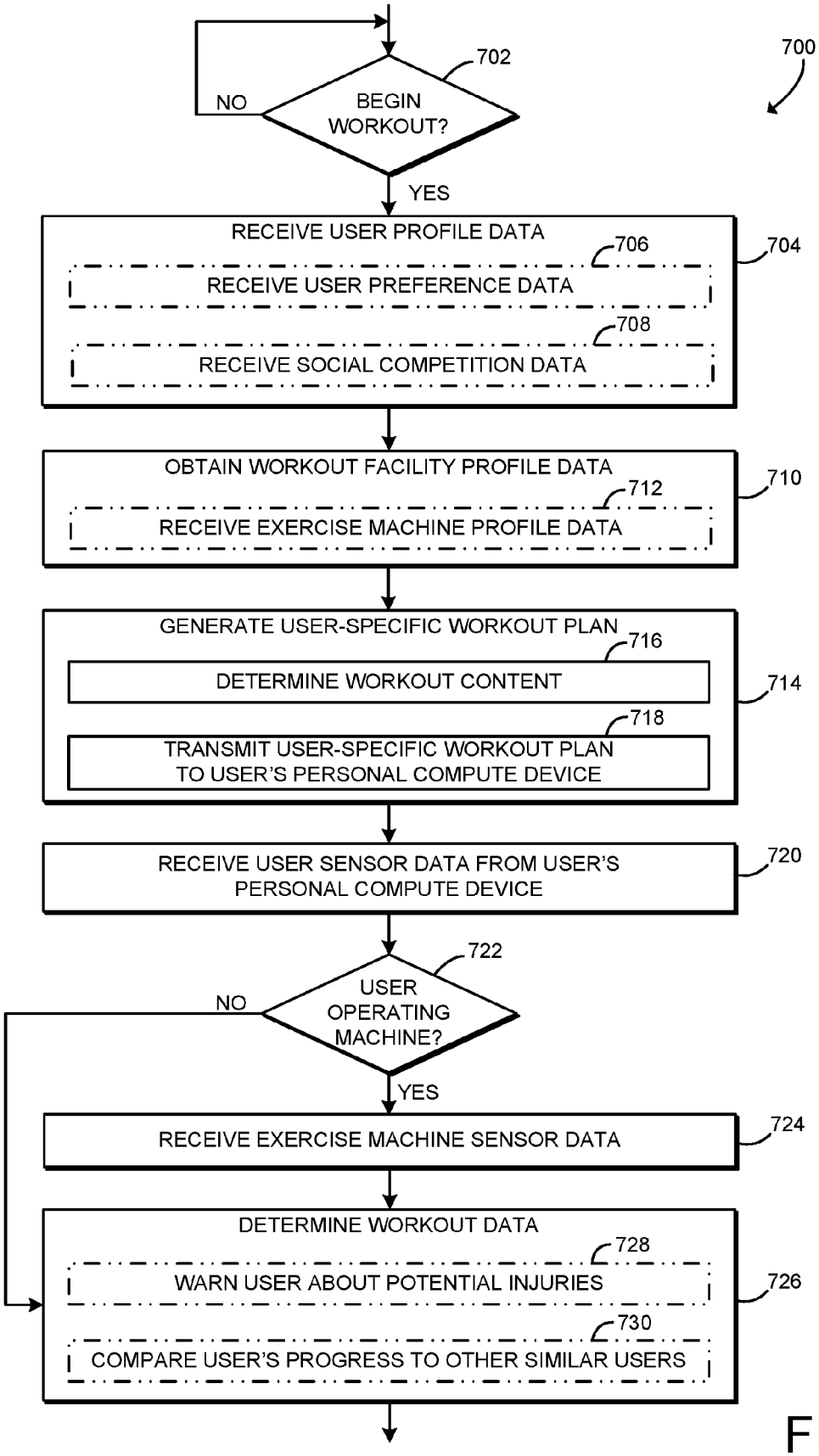
FIG. 7 is a simplified flow diagram of at least one embodiment of a method for generating a user-specific workout plan and tracking the progress of the user performing the user-specific workout plan by one or more of the servers of FIG. 2.

Referring now to FIG. 7, in use, the cloud server 102 and/or one of the workout facility servers 106, either alone or in combination, may execute a method 700 for generating a user-specific workout plan and workout data. Although described below as being executed by the server 102, 106, it should be appreciated that the method 700 may also be executed by the personal compute device 114 in some embodiments.

The method 700 begins with block 702 in which the server 102, 106 determines whether to begin a workout. To do so, the server 102, 106 may determine whether a workout request has been received (e.g., from a personal compute device 114). Subsequently, in block 704, the server 102, 106 receives user profile data related to the user 112. As discussed above, the user profile data may be included in a workout request received by the server 102, 106 or may be retrieved from the user profile database 412 based on a user identity included in the workout request. In some embodiments, the server 102, 106 may also receive, obtain, or determine user preference data, which may identify preferred or non-preferred exercises and/or user-specified training goals of the user 112 as discussed above. Additionally, the server 102, 106 may receive, obtain, or determine social competition data indicative of the workout performances of other users of the workout system 100. As discussed above, the social competition data may be filtered to highlight the performances of users that are similarly situated (e.g., similar height, weight, gender) as the user 112.

In block 710, the server 102, 106 obtains workout facility profile data. As discussed above, the workout facility profile data may include information identifying one or more exercise machines 108 located at the particular workout facility 104. Depending on the particular embodiment, the server 102, 106 may retrieve the workout facility profile data from the workout facility database 420 based on the workout facility identify information included in the workout request or receive the workout facility profile data from another compute device (e.g., the cloud server 102 may receive the workout facility profile data directly from the workout facility server 106 of the particular workout facility 104). In some embodiments, the server 102, 106 may also receive or determine exercise machine profile data for each exercise machine 108 identified in the workout facility profile data. The exercise machine profile data may be indicative of the type of each exercise machine 108 and whether the particular exercise machine 108 is equipped with one or more sensors 270 to generated exercise machine sensor data and/or actuators 272 capable of being controlled. Additionally, as discussed above, the exercise machine data may include information regarding the current state of the exercise machine (e.g., how well the exercise machine is functioning).

In block 714, the server 102, 106 generates a user-specific workout plan for the user 112 based on the user profile data and the workout facility profile data. To do so, in block 716, the server 102, 106 determines the workout content to be included in the user-specific workout plan. The server 102, 106 may utilize any useful information to determine the workout content including the user profile data, the workout facility profile data, and/or a long-term training schedule previously generated for the user 112. The workout content may identify various parameters of the user-specific workout plan including, for example, the types of exercises to be performed, the length of time each exercise is to be performed, the intensity of each exercise in the user-specific workout plan, the amount of weight to be used, the number of repetitions to be completed, and/or other factors to be considered. In determining the workout content, the server 102, 106 may select or define the exercises to be performed based on the available exercise machines 108 identified in the workout facility profile data and/or on other data. For example, the server 102, 106 may select the exercises to be performed and/or exercise machines to be used based on the user preferences, user injury information, and/or user goal information included in the user profile data. In some embodiments, a long-term training schedule may have been previously developed to help the user 112 meet one or more health performance goals. In such embodiments, the server 102, 106 may utilize the long-term training schedule to determine workout content. Once the user-specific workout plan has been determined, the server 102, 106 transmits the user-specific workout plan to the user's personal compute device 114 to assist the user 112 in performing the user-specific workout plan.

While a user 112 is exercising according to the user-specific workout plan, the servers 102, 106 may receive user sensor data from the personal compute device 114. As discussed above, the user sensor data may include information about the exercise or workout performed by the user such as the motion of the user 112 during an exercise routine and/or information about the intensity of the workout being performed by the user 112. The user sensor data may also include information about how the user 112 is reacting to the exercise, such as, for example, information about the user's heart rate, breathing rate and other vital functions of the user 112 as discussed above. Additionally, the user sensor data (e.g., sensor data indicative of a motion of the user 112) may be used to determine if the user 112 is actively performing an exercise. That is, not all exercises in a user-specific workout plan may require an exercise machine 108 and, as such, the user sensor data may be configured to provide information about those types of exercises.

In block 722, the server 102, 106 may determine whether the user 112 is operating an exercise machine 108 that is equipped with a local compute device 110 and sensors 270. Such determination may be based on information received from the personal compute device 114 of the user 112 and/or from the local compute device 110 of the exercise machine 108. If the server 102, 106 determines that the user 112 is presently operating an exercise machine 108 including a local compute device 110, the method 700 advances to block 724 in which the server 102, 106 receives exercise machine sensor data from the local compute device 110 of the exercise machine 108 used by the user 112. As discussed above, the exercise machine sensor data is indicative of one or more operational characteristic of the exercise machine 108 such as movement of the exercise machine 108, the weight used on the exercise machine 108, the duration of the workout on the exercise machine 108, and/or other data related to the use of the exercise machine 108 by the user.

Subsequently, in block 726, the server 102, 106 determines workout data indicative of one or more exercises being performed by the user 112 and transmits the workout data to the personal compute device 114 of the user 112 to provide an amount of feedback to the user 112 during her/his workout. If the server 102, 106 received exercise machine sensor data from the related exercise machine 108 in block 724, the server 102, 106 may determine the workout data based on the exercise machine sensor data. In other embodiments, however, the server 102, 106 may determine the workout data based on the user sensor data received from the personal compute device 114 of the user 112.

In some embodiments, in block 728, the server 102, 106 may provide a warning to the user 112 about potential injuries based on the determined workout data. For example, the workout data may indicate that the user 112 is working to vigorously or performing an exercise incorrectly. As such, the server 102, 106 may transmit a warning to the personal compute device 114 of the user 112 in block 728. Additionally, in block 730, the server 102, 106 may compare the user's workout data to the workout data of other similarly situated users to determine as discussed above. The comparison of the workout data may provide a benchmark for the user 112 to compare his or her performance, and may motivate the user 112 to greater efforts during the workouts. In such embodiments, the comparison data may be included in the workout data transmitted to the personal compute device 114 of the user 112. In this way, the server 102, 106 may provide real-time or near real-time feedback to the user 112 while she/he is performing an exercise of the determined user-specific workout plan. Of course, the user 112 may utilize various exercise machines 108 during a given user-specific workout plan and, in such cases, the method 700 may loop back to 722 to monitor for use of each exercise machine and provide updated workout data to the user 112 ad described above.

Figure 8:
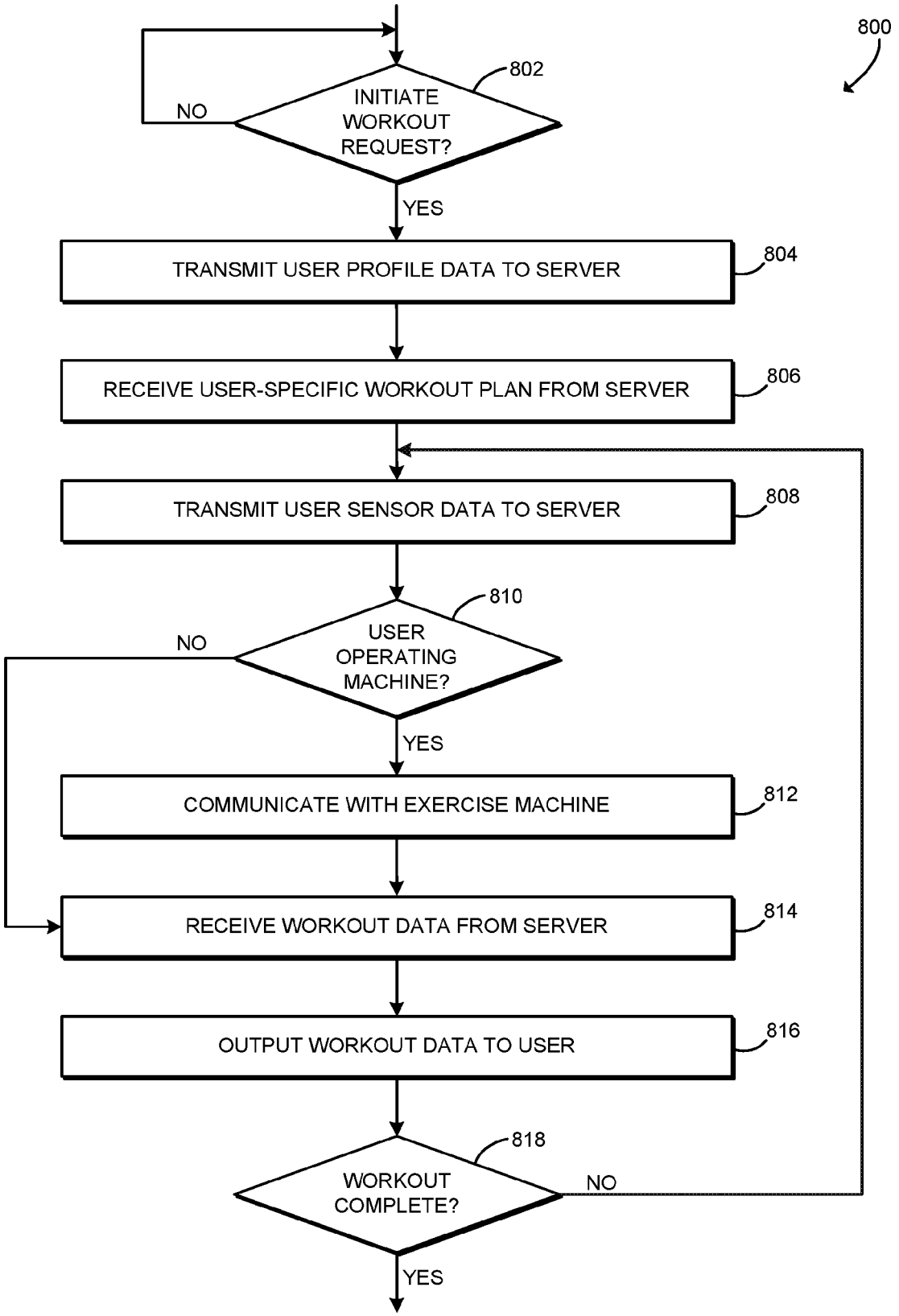
FIG. 8 is a simplified flow diagram of at least one embodiment of a method for outputting the user-specific workout plan and the user's progress by the personal compute device of FIG. 3.

Referring now to FIG. 8, in use, the personal compute device 114 of a user 112 may execute a method 800 for generating a user-specific workout plan and workout data. In the illustrative embodiment of FIG. 8, the personal compute device 114 cooperates with the either the cloud server 102 or workout facility server 106, or both, to generate the user-specific workout plan and the workout data. The method 800 begins with block 802 in which the personal compute device 114 initiates a workout request. To do so, the personal compute device 114 may initiate the workout request in response to inputs from the user 112 or in an automatic fashion in response to a determination that certain conditions have been met (e.g., the user 112 has entered a workout facility 104). As discussed above, in some embodiments, the workout request includes a workout facility identifier or other information that identifies the workout facility 104. In some embodiments, the workout request also includes the user profile data of the user 112. However, if not, the personal compute device 114 may retrieve the locally stored user profile data and transmit the user profile data to the server 102, 106 in block 804. In some embodiments, the personal compute device 114 may transmit only user identification to the server 102, 106, and the server 102, 106 may subsequently retrieve the user profile data from a local database based on such user identification.

In block 806, personal compute device 114 receives a user-specific workout plan from the servers 102, 106, which is based on the user profile data and the workout facility profile data of the identified workout facility 104 as discussed above. Upon receiving the user-specific workout plan, the personal compute device 114 may inform the user 112 of the workout plan, so that the user 112 can perform the workout plan (e.g., the personal compute device 114 may display the workout plan or exercises included in the workout plan on an output device 338 of the personal compute device 114).

As discussed above, the personal compute device 114 may be used to monitor and provide feedback to the user 112 during a workout. To do so, in block 808, the personal compute device 114 may transmit sensor data collected by the sensors 326 to the server 102, 106. The user sensor data is indicative of one or more characteristics of the user 112 (e.g., sensor data indicative of a motion of the user 112) while the user is performing an exercise included in the user-specific workout plan. As such, the user sensor data may be used to determine whether the user 112 is actively working out and the intensity of the workout.

Subsequently, in block 810, the personal compute device 114 may determine whether the user 112 is presently operating an exercise machine 108. Such determination may performed automatically based on the user sensor data received from the sensors 326 (e.g., data indicative of a motion of the user 112), the exercise machine sensor data received from local compute device 110 of the corresponding exercise machine 108, and/or the workout facility profile data. Additionally, the personal compute device 114 may infer the user 112 is presently operating an exercise machine 108 based on establishment of a communication link between the personal compute device 114 and a local compute device 110 of the corresponding exercise machine 108, which may indicate the user's presence near the exercise machine 108. Additionally, the personal compute device 114 may determine that the user 112 is operation an exercise machine 108 in response to an indication or input from the user 112 indicating that the user 112 desires to operate the exercise machine 108 to perform an exercise.

If the personal compute device 114 determines that the user 112 is operating an exercise machine 108, the method 800 advances to block 812 in which the personal compute device 114 establishes a communication with the exercise machine 108, which may be accomplished via any suitable communication technology and/or mechanism. The establishment of communication between the personal compute device 114 and the exercise machine 108 allows the server 102, 106 to correlate the exercise machine sensor data received from the exercise machine 108 with the user sensor data received from the personal compute device 114 and provide feedback information about the exercise routine to the user 112 as discussed above.

Subsequently, in block 814, the personal compute device 114 receives the workout data generated by the server 102, 106. As discussed above, the workout data includes information regarding the exercise and/or user-specific workout plan being performed by the user 112 and may be based on the exercise machine sensor data generated by the exercise machine 108 while the user 112 operates the exercise machine 108. In other embodiments, such as those in which the user 112 is operating an exercise machine 108 without a local compute device 110, the workout data may be based on the user sensor data generated by the personal compute device 114 of the user 112.

Regardless, in block 816, the personal compute device 114 provides the workout data to the user 112. For example, the personal compute device 114 may display the workout data to the user 112 on a display of the personal compute device 114. Additionally or alternatively, in some embodiments, the personal compute device 114 may provide the workout data to the user 112 through an augmented reality interface as discussed above. Subsequently, in block 818, the personal compute device 110 determines whether the workout routine being performed by the user 112 is complete. If not, the method 800 loops back to block 808 in which the personal compute device 110 continues transmit user sensor data and receive workout data from the server 102, 106 during the user's workout.

Although the method 800 has been described above in regard to the personal compute device 110 of the user 112 interacting with the server 102, 106, it should be appreciated that personal compute device 110 may perform the method 800 without interaction with the servers 102, 106 in some embodiments. That is, instead of transmitting data to the server 102, 106 in various blocks of the method 800, the personal compute device 110 may store the data locally in such blocks (e.g., the personal compute device 110 may locally store the user sensor data in block 808. Additionally, instead of receiving information from the server 102, 106 in various blocks of the method 800, the personal compute device 110 may determine the data locally (e.g., the personal compute device 110 may determine the workout data in block 814).

Figure 9:
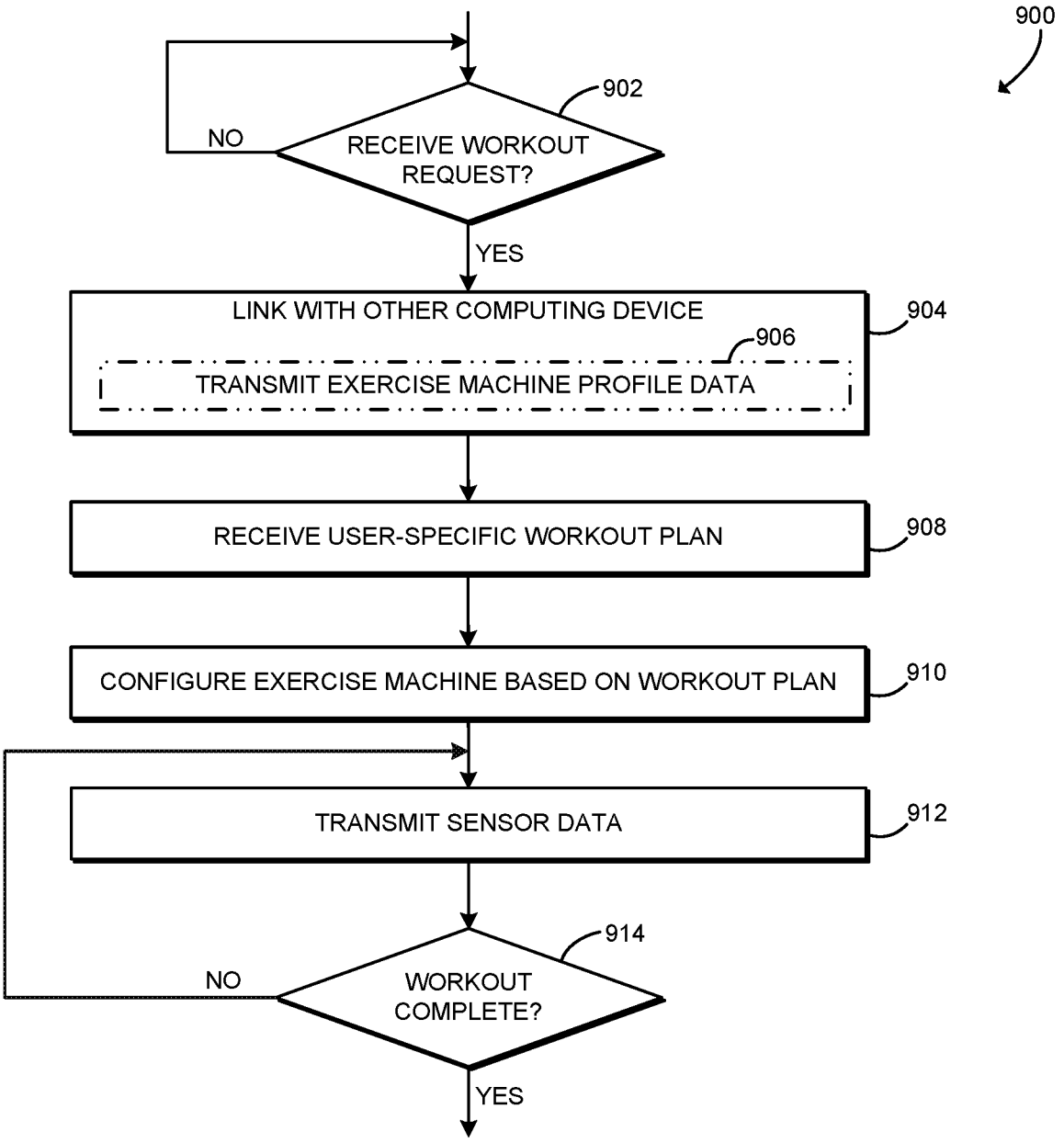
FIG. 9 is a simplified flow diagram of at least one embodiment of a method for managing an exercise machine that may be executed by the local compute device of FIG. 2.

Referring now to FIG. 9, in use, the local compute device 110 of each exercise machine 108 may execute a method 900 for generating exercise machine sensor data and for reconfiguring the exercise machine 108. The method 900 begins with block 902 in which the local compute device 110 receives a workout request that a specific user desires to operate the exercise machine 108 associated with the local compute device 110. Such workout request may be received from the personal compute device 110 of the user 112 or may be generated by the user 112 interacting with the exercise machine 108 (e.g., initiating a workout on the exercise machine 108). If a workout request is received, the method 900 advances to block 904 in which the local compute device 110 links with one or more other compute devices (e.g., the compute device from which the workout request was received). For example, in some embodiments, the personal compute device 114 may directly link with the local compute device 110, and the workout request may be received directly from the personal compute device 114. In other embodiments, the workout request is received from the either server 102 or server 106, and the local compute device 110 is configured to link with either server 102 or server 106 in some embodiments. Regardless, once linked with the other compute devices, the local compute device 110 may transmit the exercise machine data generated during a workout of the user 112 on the corresponding exercise machine 108 to the servers 102, 106 or the personal compute device 114.

In some embodiments, in block 908, the local compute device 110 may receive the user-specific workout plan, or data derived therefrom, from the compute device that is linked/connected to the local compute device 110 (e.g., from the personal compute device 114 or the server 102, 106). If so, the local compute device 110 may determine whether the workout plan includes operational data defining one or more operational parameters of the corresponding exercise machine 108 that should be adjusted for one or more workouts included in the user-specific workout plan. If so, in block 910, the local compute device 110 controls one or more 272 of the exercise machine 108 to adjust the one or more settings of the exercise machine 108 based on the operational parameters. For example, the actuators 272 maybe controlled to raise the incline of a treadmill, increase or decrease weight on the machine, adjust a seat of the machine, and/or perform other adjustments to the exercise machine 108. In this way, the user-specific workout plan may be used to automatically adjust exercise machines 108 for use by the user based on the exercises included in the plan and/or user preferences.

During the workout of the user 112 on the exercise machine 108, the local compute device 110 collects and transmits exercise machine sensor data to the linked compute device (e.g., the personal compute device 114 or server 102, 106). As discussed above, the exercise machine sensor data is indicative of one or more operational characteristics of the associated exercise machine 108 while the user is operating the exercise machine 108 to perform an exercise included in the user-specific workout plan. For example, the exercise machine sensor data may provide an indication of the intensity of the workout, the length of the workout, the amount of weight used, the speed of movements, and/or other data related to the operation of the exercise machine 108 by the user 112.

Subsequently, in block 914, the local compute device 110 determines whether the user's workout on the exercise machine 108 is complete. If not, the method 900 loops back to block 901 in which the local compute device 110 continues collecting and transmitting the exercise machine sensor data

EXAMPLES

Illustrative examples of the technologies disclosed herein are provided below. An embodiment of the technologies may include any one or more, and any combination of, the examples described below.

Example 1 includes a server for generating a user-specific workout plan, the server comprising a personalized workout module to receive a workout request sent from a personal compute device of a user, wherein the workout request is usable to obtain user profile data related to the user and workout facility profile data related to a workout facility, wherein the workout facility profile data is indicative of one or more exercise machines at the workout facility; generate a user-specific workout plan based on the user profile data and the workout facility profile data, wherein the user-specific workout plan includes one or more exercises that use at least one of the one or more excises machines, transmit the user-specific workout plan to the personal compute device of the user, receive exercise machine sensor data generated by an exercise machine included in the user-specific workout plan, the exercise machine sensor data indicative of operational characteristics of the exercise machine while operated by the user to perform an exercise included in the user-specific workout plan, and a workout data determination module to determine workout data based on the exercise machine sensor data and transmit the workout data to the personal compute device, wherein the workout data is indicative of the exercise performed on the exercise machine by the user.

Example 2 includes the subject matter of Example 1, and wherein the personalized workout module is to receive user sensor data from the personal compute device, the user sensor data is indicative of a motion of the user while the user performs the exercise, and the workout data determination module is to determine the workout data based on the exercise machine sensor data and the user sensor data.

Example 3 includes the subject matter of any of Examples 1 and 2, and wherein the personalized workout module is to receive accelerometer data from the personal compute device indicative of the motion of the user, wherein the accelerometer data is generated by one or more accelerometers communicatively coupled to the personal compute device of the user.

Example 4 includes the subject matter of any of Examples 1-3, and wherein the workout data determination module is to determine exercise data based on the exercise machine sensor data and the user sensor data, wherein the exercise data is indicative of a motion of the user while the user performed the exercise, determine risk data indicative of a risk of injury to the user by comparing the exercise data to a preferred exercise motion for the exercise, and transmit to the personal compute device of the user, the risk data indicative of the risk of injury to the user.

Example 5 includes the subject matter of any of Examples 1-4, and wherein the personalized workout module is to receive (i) workout history data of the user indicative of one or more past workouts performed by the user and (ii) health data of the user indicative of one or more health goals of the user and one or more present physical characteristics of the user.

Example 6 includes the subject matter of any of Examples 1-5, and wherein the personalized workout module is to receive social competition data indicative of workouts performed by one or more other users, wherein the one or more other users included in the social competition data are selected based on a comparison of physical characteristics of the user and the one or more other users.

Example 7 includes the subject matter of any of Examples 1-6, and wherein the personalized workout module is to determine one or more recent workouts performed by the one or more other users based on the social competition data, and generate the user-specific workout plan based on the user profile data, the workout facility profile data, and the one or more recent workouts performed by other users.

Example 8 includes the subject matter of any of Examples 1-7, and wherein the workout data determination module is to generate a comparison of the workout data to the social competition data; and transmit the comparison to the user.

Example 9 includes the subject matter of any of Examples 1-8, and wherein the personalized workout module is to obtain exercise machine data that identifies a type of the one or more exercise machines and whether the one or more exercise machines is equipped with an exercise sensor to generate the exercise machine sensor data.

Example 10 includes the subject matter of any of Examples 1-9, and wherein the workout facility profile data is indicative of whether the workout facility is a membership-based gym.

Example 11 includes the subject matter of any of Examples 1-10, and wherein the workout data determination module is to generate an augmented reality personal assistant to suggest corrections, based on the workout data, to the exercise performed by the user.

Example 12 includes the subject matter of any of Examples 1-11, and wherein the workout data is indicative of a level of intensity of the exercise performed by the user.

Example 13 includes the subject matter of any of Examples 1-12, and wherein the workout data determination module is to determine health progress data of the user indicative of a temporal-based change in a fitness level of the user.

Example 14 includes the subject matter of any of Examples 1-13, and wherein the server is associated with the workout facility and is dedicated to perform the functions required by the workout facility.

Example 15 includes a compute device for generating a user-specific workout plan, the compute device comprising a personalized workout module to generate a workout request that includes user profile data of a user and identifies a workout facility to be used by the user, receive workout facility profile data indicative of one or more exercise machines at the workout facility, generate a user-specific workout plan based on the user profile data and the workout facility profile data, wherein the user-specific workout plan includes one or more exercises that use at least one of the one or more exercise machines, receive exercise machine sensor data generated by an exercise machine included in the user-specific workout plan, the exercise machine sensor data indicative of operational characteristics of the exercise machine while operated by the user to perform an exercise included in the user-specific workout plan; and a workout data module to determine workout data based on the exercise machine sensor data, wherein the workout data is indicative of the exercise performed on the exercise machine by the user.

Example 16 includes the subject matter of Example 15, and wherein the personalized workout module is to communicative link the personal compute device to the exercise machine to receive the exercise machine sensor data therefrom.

Example 17 includes the subject matter of any of Examples 15 and 16, and wherein the personalized workout module is to generate user sensor data, the user sensor data is indicative of a motion of the user while the user performs the exercise, and the workout data module is to determine the workout data based on the exercise machine sensor data and the user sensor data.

Example 18 includes the subject matter of any of Examples 15-17, and wherein the personalized workout module is to generate accelerometer data indicative of the motion of the user, wherein the accelerometer data is generated by one or more accelerometers communicatively coupled to the personal compute device of the user.

Example 19 includes the subject matter of any of Examples 15-18, and wherein the workout data module is to determine exercise data based on the exercise machine sensor data and the user sensor data, wherein the exercise data is indicative of a motion of the user while the user performed the exercise, determine risk data indicative of a risk of injury to the user by comparing the exercise data to a preferred exercise motion for the exercise, and transmit to the personal compute device of the user, the risk data indicative of the risk of injury to the user.

Example 20 includes the subject matter of any of Examples 15-19, and wherein the personalized workout module is to obtain (i) workout history data of the user indicative of one or more past workouts performed by the user and (ii) health data of the user indicative of one or more health goals of the user and one or more present physical characteristics of the user.

Example 21 includes the subject matter of any of Examples 15-20, and wherein the personalized workout module is to obtain social competition data indicative of workouts performed by one or more other users, wherein the one or more other users included in the social competition data are selected based on a comparison of physical characteristics of the user and the one or more other users.

Example 22 includes the subject matter of any of Examples 15-21, and wherein the personalized workout module is to determine one or more recent workouts performed by the one or more other users based on the social competition data, and generate the user-specific workout plan based on the user profile data, the workout facility profile data, and the one or more recent workouts performed by other users.

Example 23 includes the subject matter of any of Examples 15-22, and wherein the workout data module is to generate a comparison of the workout data to the social competition data; and output the comparison to the user.

Example 24 includes the subject matter of any of Examples 15-23, and further including a workout facility module is to obtain exercise machine data that identifies a type of the one or more exercise machines and whether the one or more exercise machines is equipped with an exercise sensor to generate the exercise machine sensor data.

Example 25 includes the subject matter of any of Examples 15-24, and wherein the workout facility profile data is indicative of whether the workout facility is a membership-based gym.

Example 26 includes the subject matter of any of Examples 15-25, and wherein the workout data module is to generate an augmented reality personal assistant to suggest corrections, based on the workout data, to the exercise performed by the user.

Example 27 includes the subject matter of any of Examples 15-26, and wherein the workout data is indicative of a level of intensity of the exercise performed by the user.

Example 28 includes the subject matter of any of Examples 15-27, and wherein the workout data module is to determine health progress data of the user indicative of a temporal-based change in a fitness level of the user.

Example 29 includes an exercise machine for tracking user operation, the exercise machine comprising one or more sensors to generate sensor data indicative of operational characteristics of the exercise machine while operated by a user; a communication module to (i) establish, based on operation of the exercise machine by the user, a communication link with a compute device of the user and (ii) receive a user-specific workout plan from the compute device, wherein the user-specific workout plan includes an exercise that uses the exercise machine; and a sensor management module to receive the sensor data from the one or more sensors and generate exercise machine sensor data based on the sensor data, wherein the communication module is further to transmit the exercise machine sensor data to the compute device of the user.

Example 30 includes the subject matter of Example 29, and wherein the user-specific workout plan includes operational data that defines at least on operational parameter of the exercise machine, and wherein the exercise machine further comprises an actuator management module to adjust, without direction from the user, an operational parameter of the exercise machine base on the operational data.

Example 31 includes the subject matter of any of Examples 29 and 30, and wherein to adjust the operational parameter comprises to adjust a physical structure of the exercise machine.

Example 32 includes the subject matter of any of Examples 29-31, and to adjust the physical structure of the exercise machine comprises to control one or more actuators of the exercise machine to adjust the physical structure.

Example 33 includes a method of generating a user-specific workout plan, the method comprising receiving, by a server, a workout request sent from a personal compute device of a user, the workout request identifying a workout facility and user profile data of the user; obtaining, by the server, workout facility profile data indicative of one or more exercise machines at the workout facility; generating, by the server, a user-specific workout plan based on the user profile data and the workout facility profile data, wherein the user-specific workout plan includes one or more exercises that use at least one of the one or more exercise machines; transmitting, by the server, the user-specific workout plan to the personal compute device of the user; receiving, by the server, exercise machine sensor data generated by an exercise machine included in the user-specific workout plan, the exercise machine sensor data indicative of operational characteristics of the exercise machine while operated by the user to perform an exercise included in the user-specific workout plan; determining, by the server, workout data based on the exercise machine sensor data; and transmitting, by the server, the workout data to the personal compute device, wherein the workout data is indicative of the exercise performed on the exercise machine by the user.

Example 34 includes the subject matter of Example 33, and further including receiving, by the server, user sensor data from the personal compute device, the user sensor data being indicative of a motion of the user while the user performs the exercise, wherein determining the workout data comprises determining, by the server, the workout data based on the exercise machine sensor data and the user sensor data.

Example 35 includes the subject matter of any of Examples 33 and 34, and wherein receiving user sensor data comprises receiving, by the server, accelerometer data from the personal compute device indicative of the motion of the user, wherein the accelerometer data is generated by one or more accelerometers communicatively coupled to the personal compute device of the user.

Example 36 includes the subject matter of any of Examples 33-35, and wherein determining workout data comprises determining, by the server, exercise data based on the exercise machine sensor data and the user sensor data, wherein the exercise data is indicative of a motion of the user while the user performed the exercise, determining, by the server, risk data indicative of a risk of injury to the user by comparing the exercise data to a preferred exercise motion for the exercise, and transmitting, by the server, to the personal compute device of the user, the risk data indicative of the risk of injury to the user.

Example 37 includes the subject matter of any of Examples 33-36, and wherein receiving the workout request further comprises receiving, by the server, (i) workout history data of the user indicative of one or more past workouts performed by the user and (ii) health data of the user indicative of one or more health goals of the user and one or more present physical characteristics of the user.

Example 38 includes the subject matter of any of Examples 33-37, and wherein receiving the workout request further comprises receiving, by the server, social competition data indicative of workouts performed by one or more other users, wherein the one or more other users included in the social competition data are selected based on a comparison of physical characteristics of the user and the one or more other users.

Example 39 includes the subject matter of any of Examples 33-38, and wherein generating the user-specific workout plan comprises determining, by the server, one or more recent workouts performed by the one or more other users based on the social competition data, and generating, by the server, the user-specific workout plan based on the user profile data, the workout facility profile data, and the one or more recent workouts performed by other users.

Example 40 includes the subject matter of any of Examples 33-39, and further including generating, by the server, a comparison of the workout data to the social competition data; and transmitting, by the server, the comparison to the user.

Example 41 includes the subject matter of any of Examples 33-40, and wherein obtaining workout facility profile data comprises obtaining, by the server, exercise machine data that identifies a type of the one or more exercise machines and whether the one or more exercise machines is equipped with an exercise sensor to generate the exercise machine sensor data.

Example 42 includes the subject matter of any of Examples 33-41, and wherein the workout facility profile data is indicative of whether the workout facility is a membership-based gym.

Example 43 includes the subject matter of any of Examples 33-42, and further including generating, by the server, an augmented reality personal assistant to suggest corrections, based on the workout data, to the exercise performed by the user.

Example 44 includes the subject matter of any of Examples 33-43, and wherein the workout data is indicative of a level of intensity of the exercise performed by the user.

Example 45 includes the subject matter of any of Examples 33-44, and wherein determining workout data comprises determining, by the server, health progress data of the user indicative of a temporal-based change in a fitness level of the user.

Example 46 includes the subject matter of any of Examples 33-45, and wherein the server is associated with the workout facility and is dedicated to perform the functions required by the workout facility.

Example 47 includes a method for generating a user-specific workout plan, the method comprising generating, by a personal compute device, a workout request that includes user profile data of a user and identifies a workout facility to be used by the user; receiving, by the personal compute device, workout facility profile data indicative of one or more exercise machines at the workout facility; generating, by the personal compute device, a user-specific workout plan based on the user profile data and the workout facility profile data, wherein the user-specific workout plan includes one or more exercises that use at least one of the one or more exercise machines; receiving, by the personal compute device, exercise machine sensor data generated by an exercise machine included in the user-specific workout plan, the exercise machine sensor data indicative of operational characteristics of the exercise machine while operated by the user to perform an exercise included in the user-specific workout plan; and determining workout data based on the exercise machine sensor data, wherein the workout data is indicative of the exercise performed on the exercise machine by the user.

Example 48 includes the subject matter of Example 47, and further including communicatively linking, by the personal compute device, the personal compute device to the exercise machine to receive the exercise machine sensor data therefrom.

Example 49 includes the subject matter of any of Examples 47 and 48, and further including generating, by the personal compute device, user sensor data, the user sensor data being indicative of a motion of the user while the user performs the exercise, wherein determining the workout data comprises determining, by the personal compute device, the workout data based on the exercise machine sensor data and the user sensor data.

Example 50 includes the subject matter of any of Examples 47-49, and wherein generating user sensor data comprises generating, by the personal compute device, accelerometer data indicative of the motion of the user, wherein the accelerometer data is generated by one or more accelerometers communicatively coupled to the personal compute device of the user.

Example 51 includes the subject matter of any of Examples 47-50, and wherein determining workout data comprises determining, by the personal compute device, exercise data based on the exercise machine sensor data and the user sensor data, wherein the exercise data is indicative of a motion of the user while the user performed the exercise, determining, by the personal compute device, risk data indicative of a risk of injury to the user by comparing the exercise data to a preferred exercise motion for the exercise, and outputting, by the personal compute device, to the personal compute device of the user, the risk data indicative of the risk of injury to the user.

Example 52 includes the subject matter of any of Examples 47-51, and wherein generating the workout request further comprises obtaining, by the personal compute device, (i) workout history data of the user indicative of one or more past workouts performed by the user and (ii) health data of the user indicative of one or more health goals of the user and one or more present physical characteristics of the user.

Example 53 includes the subject matter of any of Examples 47-52, and wherein generating the workout request further comprises obtaining, by the personal compute device, social competition data indicative of workouts performed by one or more other users, wherein the one or more other users included in the social competition data are selected based on a comparison of physical characteristics of the user and the one or more other users.

Example 54 includes the subject matter of any of Examples 47-53, and wherein generating the user-specific workout plan comprises determining, by the personal compute device, one or more recent workouts performed by the one or more other users based on the social competition data, and generating, by the personal compute device, the user-specific workout plan based on the user profile data, the workout facility profile data, and the one or more recent workouts performed by other users.

Example 55 includes the subject matter of any of Examples 47-54, and further including generating, by the personal compute device, a comparison of the workout data to the social competition data; and outputting, by the personal compute device, the comparison to the user.

Example 56 includes the subject matter of any of Examples 47-55, and wherein obtaining workout facility profile data comprises obtaining, by the personal compute device, exercise machine data that identifies a type of the one or more exercise machines and whether the one or more exercise machines is equipped with an exercise sensor to generate the exercise machine sensor data.

Example 57 includes the subject matter of any of Examples 47-56, and wherein the workout facility profile data is indicative of whether the workout facility is a membership-based gym.

Example 58 includes the subject matter of any of Examples 47-57, and further including generating, by the personal compute device, an augmented reality personal assistant to suggest corrections, based on the workout data, to the exercise performed by the user.

Example 59 includes the subject matter of any of Examples 47-58, and wherein the workout data is indicative of a level of intensity of the exercise performed by the user.

Example 60 includes the subject matter of any of Examples 47-59, and wherein determining workout data comprises determining, by the personal compute device, health progress data of the user indicative of a temporal-based change in a fitness level of the user.

Example 61 includes a method for tracking operation of an exercise machine, the method comprising communicatively linking, by the exercise machine and based on operation of the exercise machine by the user, with a compute device of a user; receiving, by the exercise machine and from the compute device, a user-specific workout plan including an exercise that uses the exercise machine; and transmitting, by the exercise machine and to the compute device, exercise machine sensor data derived from one or more sensors of the exercise machine, wherein the exercise machine data is indicative of operational characteristics of the exercise machine while operated by the user to perform the exercise.

Example 62 includes the subject matter of Example 61, and wherein the user-specific workout plan includes operational data that defines at least one operational parameter of the exercise machine, and further comprising adjusting, by the exercise machine and without direction from the user, an operational parameter of the exercise machine based on the operational data.

Example 63 includes the subject matter of any of Examples 61 and 62, and wherein adjusting the operational parameter comprises adjusting a physical structure of the exercise machine.

Example 64 includes the subject matter of any of Examples 61-63, and wherein adjusting the physical structure comprises controlling an actuator of the exercise machine to adjust the physical structure.

Example 65 includes one or more machine readable storage media comprising a plurality of instructions stored thereon that in response to being executed result in a compute device performing the method of any of Examples 33-64.

Example 66 includes a server for generating a user-specific workout plan, the server comprising means for receiving a workout request sent from a personal compute device of a user, the workout request identifying a workout facility and user profile data of the user; means for obtaining workout facility profile data indicative of one or more exercise machines at the workout facility; means for generating a user-specific workout plan based on the user profile data and the workout facility profile data, wherein the user-specific workout plan includes one or more exercises that use at least one of the one or more exercise machines; means for transmitting the user-specific workout plan to the personal compute device of the user; means for receiving exercise machine sensor data generated by an exercise machine included in the user-specific workout plan, the exercise machine sensor data indicative of operational characteristics of the exercise machine while operated by the user to perform an exercise included in the user-specific workout plan; means for determining workout data based on the exercise machine sensor data; and means for transmitting the workout data to the personal compute device, wherein the workout data is indicative of the exercise performed on the exercise machine by the user.

Example 67 includes the subject matter of Example 66, and further including means for receiving user sensor data from the personal compute device, the user sensor data being indicative of a motion of the user while the user performs the exercise, wherein the means for determining the workout data comprises means for determining the workout data based on the exercise machine sensor data and the user sensor data.

Example 68 includes the subject matter of any of Examples 66 and 67, and wherein the means for receiving user sensor data comprises means for receiving accelerometer data from the personal compute device indicative of the motion of the user, wherein the accelerometer data is generated by one or more accelerometers communicatively coupled to the personal compute device of the user.

Example 69 includes the subject matter of any of Examples 66-68, and wherein the means for determining workout data comprises means for determining exercise data based on the exercise machine sensor data and the user sensor data, wherein the exercise data is indicative of a motion of the user while the user performed the exercise, means for determining risk data indicative of a risk of injury to the user by comparing the exercise data to a preferred exercise motion for the exercise, and means for transmitting to the personal compute device of the user, the risk data indicative of the risk of injury to the user.

Example 70 includes the subject matter of any of Examples 66-69, and wherein the means for receiving the workout request further comprises means for receiving (i) workout history data of the user indicative of one or more past workouts performed by the user and (ii) health data of the user indicative of one or more health goals of the user and one or more present physical characteristics of the user.

Example 71 includes the subject matter of any of Examples 66-70, and wherein the means for receiving the workout request further comprises means for receiving social competition data indicative of workouts performed by one or more other users, wherein the one or more other users included in the social competition data are selected based on a comparison of physical characteristics of the user and the one or more other users.

Example 72 includes the subject matter of any of Examples 66-71, and wherein the means for generating the user-specific workout plan comprises means for determining one or more recent workouts performed by the one or more other users based on the social competition data, and means for generating the user-specific workout plan based on the user profile data, the workout facility profile data, and the one or more recent workouts performed by other users.

Example 73 includes the subject matter of any of Examples 66-72, and further including means for generating a comparison of the workout data to the social competition data; and means for transmitting the comparison to the user.

Example 74 includes the subject matter of any of Examples 66-73, and wherein the means for obtaining workout facility profile data comprises means for obtaining exercise machine data that identifies a type of the one or more exercise machines and whether the one or more exercise machines is equipped with an exercise sensor to generate the exercise machine sensor data.

Example 75 includes the subject matter of any of Examples 66-74, and wherein the workout facility profile data is indicative of whether the workout facility is a membership-based gym.

Example 76 includes the subject matter of any of Examples 66-75, and further including means for generating an augmented reality personal assistant to suggest corrections, based on the workout data, to the exercise performed by the user.

Example 77 includes the subject matter of any of Examples 66-76, and wherein the workout data is indicative of a level of intensity of the exercise performed by the user.

Example 78 includes the subject matter of any of Examples 66-77, and wherein the means for determining workout data comprises means for determining health progress data of the user indicative of a temporal-based change in a fitness level of the user.

Example 79 includes the subject matter of any of Examples 66-78, and wherein the server is associated with the workout facility and is dedicated to perform the functions required by the workout facility.

Example 80 includes a personal compute device for generating a user-specific workout plan, the personal compute device comprising means for generating a workout request that includes user profile data of a user and identifies a workout facility to be used by the user; means for receiving workout facility profile data indicative of one or more exercise machines at the workout facility; means for generating a user-specific workout plan based on the user profile data and the workout facility profile data, wherein the user-specific workout plan includes one or more exercises that use at least one of the one or more exercise machines; means for receiving exercise machine sensor data generated by an exercise machine included in the user-specific workout plan, the exercise machine sensor data indicative of operational characteristics of the exercise machine while operated by the user to perform an exercise included in the user-specific workout plan; and means for determining workout data based on the exercise machine sensor data, wherein the workout data is indicative of the exercise performed on the exercise machine by the user.

Example 81 includes the subject matter of Example 80, and further including means for communicatively linking the personal compute device to the exercise machine to receive the exercise machine sensor data therefrom.

Example 82 includes the subject matter of any of Examples 80 and 81, and further including means for generating user sensor data, the user sensor data being indicative of a motion of the user while the user performs the exercise, wherein the means for determining the workout data comprises means for determining the workout data based on the exercise machine sensor data and the user sensor data.

Example 83 includes the subject matter of any of Examples 80-82, and wherein the means for generating user sensor data comprises means for generating accelerometer data indicative of the motion of the user, wherein the accelerometer data is generated by one or more accelerometers communicatively coupled to the personal compute device of the user.

Example 84 includes the subject matter of any of Examples 80-83, and wherein the means for determining workout data comprises means for determining exercise data based on the exercise machine sensor data and the user sensor data, wherein the exercise data is indicative of a motion of the user while the user performed the exercise, means for determining risk data indicative of a risk of injury to the user by comparing the exercise data to a preferred exercise motion for the exercise, and means for outputting to the personal compute device of the user, the risk data indicative of the risk of injury to the user.

Example 85 includes the subject matter of any of Examples 80-84, and wherein the means for generating the workout request further comprises means for obtaining (i) workout history data of the user indicative of one or more past workouts performed by the user and (ii) health data of the user indicative of one or more health goals of the user and one or more present physical characteristics of the user.

Example 86 includes the subject matter of any of Examples 80-85, and wherein the means for generating the workout request further comprises means for obtaining social competition data indicative of workouts performed by one or more other users, wherein the one or more other users included in the social competition data are selected based on a comparison of physical characteristics of the user and the one or more other users.

Example 87 includes the subject matter of any of Examples 80-86, and, wherein the means for generating the user-specific workout plan comprises means for determining one or more recent workouts performed by the one or more other users based on the social competition data, and means for generating the user-specific workout plan based on the user profile data, the workout facility profile data, and the one or more recent workouts performed by other users.

Example 88 includes the subject matter of any of Examples 80-87, and further including means for generating a comparison of the workout data to the social competition data; and means for outputting the comparison to the user.

Example 89 includes the subject matter of any of Examples 80-88, and wherein the means for obtaining workout facility profile data comprises means for obtaining exercise machine data that identifies a type of the one or more exercise machines and whether the one or more exercise machines is equipped with an exercise sensor to generate the exercise machine sensor data.

Example 90 includes the subject matter of any of Examples 80-89, and wherein the workout facility profile data is indicative of whether the workout facility is a membership-based gym.

Example 91 includes the subject matter of any of Examples 80-90, and, further including means for generating an augmented reality personal assistant to suggest corrections, based on the workout data, to the exercise performed by the user.

Example 92 includes the subject matter of any of Examples 80-91, and wherein the workout data is indicative of a level of intensity of the exercise performed by the user.

Example 93 includes the subject matter of any of Examples 80-92, and wherein the means for determining workout data comprises means for determining health progress data of the user indicative of a temporal-based change in a fitness level of the user.

Example 94 includes an exercise machine for tracking user operation, the exercise machine comprising means for communicatively linking, based on operation of the exercise machine by the user, with a compute device of a user; means for receiving, from the compute device, a user-specific workout plan including an exercise that uses the exercise machine; and means for transmitting, to the compute device, exercise machine sensor data derived from one or more sensors of the exercise machine, wherein the exercise machine data is indicative of operational characteristics of the exercise machine while operated by the user to perform the exercise.

Example 95 includes the subject matter of Example 94, and wherein the user-specific workout plan includes operational data that defines at least one operational parameter of the exercise machine, and further comprising means for adjusting, without direction from the user, an operational parameter of the exercise machine based on the operational data.

Example 96 includes the subject matter of any of Examples 94 and 95, and wherein the means for adjusting the operational parameter comprises means for adjusting a physical structure of the exercise machine.

Example 97 includes the subject matter of any of Examples 94-96, and wherein the means for adjusting the physical structure comprises means for controlling an actuator of the exercise machine to adjust the physical structure.

The invention claimed is:

1. A server for generating a user-specific workout plan, the server comprising:

a personalized workout module to:

receive a workout request sent from a personal compute device of a user, wherein the workout request is usable to obtain user profile data related to the user and workout facility profile data related to a workout facility, wherein the workout facility profile data is indicative of one or more exercise machines at the workout facility;

generate a user-specific workout plan based on the user profile data and the workout facility profile data, wherein the user-specific workout plan includes one or more exercises that use at least one of the one or more excises machines, transmit the user-specific workout plan to the personal compute device of the user, receive exercise machine sensor data generated by an exercise machine included in the user-specific workout plan, the exercise machine sensor data indicative of operational characteristics of the exercise machine while operated by the user to perform an exercise included in the user-specific workout plan, and a workout data determination module to determine workout data based on the exercise machine sensor data and transmit the workout data to the personal compute device, wherein the workout data is indicative of the exercise performed on the exercise machine by the user.

2. The server of claim 1, wherein:

the personalized workout module is to receive user sensor data from the personal compute device, the user sensor data is indicative of a motion of the user while the user performs the exercise, and the workout data determination module is to determine the workout data based on the exercise machine sensor data and the user sensor data.

3. The server of claim 2, wherein the workout data determination module is to:

determine exercise data based on the exercise machine sensor data and the user sensor data, wherein the exercise data is indicative of a motion of the user while the user performed the exercise, determine risk data indicative of a risk of injury to the user by comparing the exercise data to a preferred exercise motion for the exercise, and transmit to the personal compute device of the user, the risk data indicative of the risk of injury to the user.

4. The server of claim 1, wherein the personalized workout module is to:

receive social competition data indicative of workouts performed by one or more other users, wherein the one or more other users included in the social competition data are selected based on a comparison of physical characteristics of the user and the one or more other users;

determine one or more recent workouts performed by the one or more other users based on the social competition data, and generate the user-specific workout plan based on the user profile data, the workout facility profile data, and the one or more recent workouts performed by other users.

5. The server of claim 1, wherein the workout data determination module is to generate an augmented reality personal assistant to suggest corrections, based on the workout data, to the exercise performed by the user.

6. One or more non-transitory, machine readable storage media comprising a plurality of instructions stored thereon that, when executed, cause a server to:

receive a workout request sent from a personal compute device of a user, the workout request identifying a workout facility and user profile data of the user;

obtain workout facility profile data indicative of one or more exercise machines at the workout facility;

generate a user-specific workout plan based on the user profile data and the workout facility profile data, wherein the user-specific workout plan includes one or more exercises that use at least one of the one or more exercise machines;

transmit the user-specific workout plan to the personal compute device of the user;

receive exercise machine sensor data generated by an exercise machine included in the user-specific workout plan, the exercise machine sensor data indicative of operational characteristics of the exercise machine while operated by the user to perform an exercise included in the user-specific workout plan;

determine workout data based on the exercise machine sensor data; and transmit the workout data to the personal compute device, wherein the workout data is indicative of the exercise performed on the exercise machine by the user.

7. The one or more non-transitory, machine readable storage media of claim 6, wherein the plurality of instructions, when executed, further cause the server to receive user sensor data from the personal compute device, the user sensor data being indicative of a motion of the user while the user performs the exercise, wherein to determine the workout data comprises to determine the workout data based on the exercise machine sensor data and the user sensor data.

8. The one or more non-transitory, machine readable storage media of claim 6, wherein to:

receive the workout request further comprises to receive social competition data indicative of workouts performed by one or more other users, wherein the one or more other users included in the social competition data are selected based on a comparison of physical characteristics of the user and the one or more other users; and generate the user-specific workout plan comprises to (i) determine one or more recent workouts performed by the one or more other users based on the social competition data, and (ii) generate the user-specific workout plan based on the user profile data, the workout facility profile data, and the one or more recent workouts performed by other users.

9. The one or more non-transitory, machine readable storage media of claim 6, wherein the plurality of instructions, when executed, further cause the server to generate an augmented reality personal assistant to suggest corrections, based on the workout data, to the exercise performed by the user.

10. The compute device of claim 6, wherein:

the personalized workout module is to generate user sensor data, the user sensor data is indicative of a motion of the user while the user performs the exercise, and the workout data module is to determine the workout data based on the exercise machine sensor data and the user sensor data.

11. The compute device of claim 7, wherein the workout data module is to:

determine exercise data based on the exercise machine sensor data and the user sensor data, wherein the exercise data is indicative of a motion of the user while the user performed the exercise, determine risk data indicative of a risk of injury to the user by comparing the exercise data to a preferred exercise motion for the exercise, and transmit to the personal compute device of the user, the risk data indicative of the risk of injury to the user.

12. The compute device of claim 6, wherein the personalized workout module is to:

obtain social competition data indicative of workouts performed by one or more other users, wherein the one or more other users included in the social competition data are selected based on a comparison of physical characteristics of the user and the one or more other users;

determine one or more recent workouts performed by the one or more other users based on the social competition data, and generate the user-specific workout plan based on the user profile data, the workout facility profile data, and the one or more recent workouts performed by other users.

13. The compute device of claim 6, wherein the workout data module is to generate an augmented reality personal assistant to suggest corrections, based on the workout data, to the exercise performed by the user.

14. The one or more non-transitory, machine readable storage media of claim 12, wherein to determine workout data comprises to:

determine exercise data based on the exercise machine sensor data and the user sensor data, wherein the exercise data is indicative of a motion of the user while the user performed the exercise, determine risk data indicative of a risk of injury to the user by comparing the exercise data to a preferred exercise motion for the exercise, and transmit to the personal compute device of the user, the risk data indicative of the risk of injury to the user.

15. A compute device for generating a user-specific workout plan, the compute device comprising:

a personalized workout module to:

generate a workout request that includes user profile data of a user and identifies a workout facility to be used by the user, receive workout facility profile data indicative of one or more exercise machines at the workout facility, generate a user-specific workout plan based on the user profile data and the workout facility profile data, wherein the user-specific workout plan includes one or more exercises that use at least one of the one or more exercise machines, receive exercise machine sensor data generated by an exercise machine included in the user-specific workout plan, the exercise machine sensor data indicative of operational characteristics of the exercise machine while operated by the user to perform an exercise included in the user-specific workout plan; and a workout data module to determine workout data based on the exercise machine sensor data, wherein the workout data is indicative of the exercise performed on the exercise machine by the user.

16. One or more non-transitory, machine readable storage media comprising a plurality of instructions stored thereon that, when executed, cause a compute device to:

generate a workout request that includes user profile data of a user and identifies a workout facility to be used by the user;

receive workout facility profile data indicative of one or more exercise machines at the workout facility;

generate a user-specific workout plan based on the user profile data and the workout facility profile data, wherein the user-specific workout plan includes one or more exercises that use at least one of the one or more exercise machines;

receive exercise machine sensor data generated by an exercise machine included in the user-specific workout plan, the exercise machine sensor data indicative of operational characteristics of the exercise machine while operated by the user to perform an exercise included in the user-specific workout plan; and determine workout data based on the exercise machine sensor data, wherein the workout data is indicative of the exercise performed on the exercise machine by the user.

17. The one or more non-transitory, machine readable storage media of claim 16, wherein the plurality of instructions, when executed, further cause the compute device to generate user sensor data, the user sensor data being indicative of a motion of the user while the user performs the exercise, wherein to determine the workout data comprises to determine the workout data based on the exercise machine sensor data and the user sensor data.

18. The one or more non-transitory, machine readable storage media of claim 17, wherein to determine workout data comprises to:

determine exercise data based on the exercise machine sensor data and the user sensor data, wherein the exercise data is indicative of a motion of the user while the user performed the exercise, determine risk data indicative of a risk of injury to the user by comparing the exercise data to a preferred exercise motion for the exercise, and output to the personal compute device of the user, the risk data indicative of the risk of injury to the user.

19. The one or more non-transitory, machine readable storage media of claim 16, wherein to:

generate the workout request further comprises to obtain social competition data indicative of workouts performed by one or more other users, wherein the one or more other users included in the social competition data are selected based on a comparison of physical characteristics of the user and the one or more other users; and generate the user-specific workout plan comprises to (i) determine one or more recent workouts performed by the one or more other users based on the social competition data, and (ii) generate the user-specific workout plan based on the user profile data, the workout facility profile data, and the one or more recent workouts performed by other users.

20. The one or more non-transitory, machine readable storage media of claim 16, wherein the plurality of instructions, when executed, further cause the compute device to generate an augmented reality personal assistant to suggest corrections, based on the workout data, to the exercise performed by the user.

21. A method of generating a user-specific workout plan, the method comprising:

receiving, by a server, a workout request sent from a personal computing device of a user, the workout request identifying a workout facility and user profile data of the user;

obtaining, by the server, workout facility profile data indicative of one or more exercise machines at the workout facility;

generating, by the server, a user-specific workout plan based on the user profile data and the workout facility profile data, wherein the user-specific workout plan includes one or more exercises that use at least one of the one or more exercise machines;

transmitting, by the server, the user-specific workout plan to the personal computing device of the user;

receiving, by the server, exercise machine sensor data generated by an exercise machine included in the user-specific workout plan, the exercise machine sensor data indicative of operational characteristics of the exercise machine while operated by the user to perform an exercise included in the user-specific workout plan;

determining, by the server, workout data based on the exercise machine sensor data; and transmitting, by the server, the workout data to the personal computing device, wherein the workout data is indicative of the exercise performed on the exercise machine by the user.

22. The method of claim 21, further comprising:

receiving, by the server, user sensor data from the personal computing device, the user sensor data being indicative of a motion of the user while the user performs the exercise, wherein determining the workout data comprises determining, by the server, the workout data based on the exercise machine sensor data and the user sensor data.

23. A method for generating a user-specific workout plan, the method comprising:

generating, by a personal computing device, a workout request that includes user profile data of a user and identifies a workout facility to be used by the user;

receiving, by the personal computing device, workout facility profile data indicative of one or more exercise machines at the workout facility;

generating, by the personal computing device, a user-specific workout plan based on the user profile data and the workout facility profile data, wherein the user-specific workout plan includes one or more exercises that use at least one of the one or more exercise machines;

receiving, by the personal computing device, exercise machine sensor data generated by an exercise machine included in the user-specific workout plan, the exercise machine sensor data indicative of operational characteristics of the exercise machine while operated by the user to perform an exercise included in the user-specific workout plan; and determining workout data based on the exercise machine sensor data, wherein the workout data is indicative of the exercise performed on the exercise machine by the user.

24. The method of claim 23, further comprising:

generating, by the personal computing device, user sensor data, the user sensor data being indicative of a motion of the user while the user performs the exercise, wherein determining the workout data comprises determining, by the personal computing device, the workout data based on the exercise machine sensor data and the user sensor data.

* * * * *